US007610697B2

(12) United States Patent
Lee

(10) Patent No.: US 7,610,697 B2
(45) Date of Patent: Nov. 3, 2009

(54) AUTOMATIC DRAINING APPARATUS OF CONDENSATION

(76) Inventor: Wan Young Lee, 103-202 Gwanak Hyeondae Apt., 1000 Bongcheon 3-dong, Gwanak-gu, Seoul 151-755 (KR)

( * ) Notice: Subject to any disclaimer, the term of this patent is extended or adjusted under 35 U.S.C. 154(b) by 275 days.

(21) Appl. No.: 11/613,454

(22) Filed: Dec. 20, 2006

(65) Prior Publication Data

US 2007/0144198 A1 Jun. 28, 2007

(30) Foreign Application Priority Data

Dec. 26, 2005 (KR) ..... 10-2005-0129847

(51) Int. Cl.
*F04F 10/00* (2006.01)
*F02M 25/00* (2006.01)

(52) U.S. Cl. ..... 37/135; 137/131; 137/165; 137/150.5; 137/151; 137/152; 62/285

(58) Field of Classification Search ..... 62/291; 137/123–134, 143
See application file for complete search history.

(56) References Cited

U.S. PATENT DOCUMENTS 4,059,126 A 11/1977 Nickerson
4,361,522 A 11/1982 Goettl
4,589,280 A 5/1986 Carter
5,212,958 A 5/1993 Anderson
5,293,894 A 3/1994 Fleischmann
5,540,355 A 7/1996 Hancock et al.
5,987,909 A 11/1999 Martin
6,311,507 B1 11/2001 Gameiro
2004/0000335 A1 1/2004 Kopel
2005/0005625 A1* 1/2005 Lee ..... 62/285

FOREIGN PATENT DOCUMENTS

JP 55152385 11/1980

* cited by examiner

*Primary Examiner*—Frantz F Jules
*Assistant Examiner*—Emmanuel Duke
(74) *Attorney, Agent, or Firm*—Holme Roberts & Owen LLP

(57) ABSTRACT

An automatic draining apparatus of condensation comprises a condensation tank; a float moving up/down along the level of the condensation; a hydraulic pressure chamber consisting of a volume changeable container for containing the condensation, and a check valve provided at an inlet of the hydraulic pressure chamber, the check valve allowing the condensation to flow only into the container, the rising float pulling up the hydraulic pressure chamber so that the volume of the container is reduced and the condensation of the container is pressurized; and a siphon having an inlet connected to the hydraulic pressure, and an outlet being provided at outside and a level of the outlet placing at a lower level of the inlet, the siphon draining the condensation into the outside when the siphon is filled with the condensation discharged from the compressed hydraulic pressure chamber.

12 Claims, 38 Drawing Sheets

AUTOMATIC DRAINING APPARATUS OF CONDENSATION

BACKGROUND OF THE INVENTION

1. Field of the Invention

The present invention is related to an automatic drain apparatus of condensation formed at an air conditioner or a dehumidifier to the outside, and more particularly, to an automatic apparatus of condensation by which condensation is pumped by the buoyancy of the condensation to fill the siphon, and condensation is fully discharged with no energy and no noise.

2. Description of the Prior Art

As it is well know, an air conditioner is an apparatus for maintaining properly the indoor temperature using a refrigerating cycle, which is widely used in the world in large, including general homes.

In the refrigerating cycle, low temperature low pressure refrigerant is compressed by a compressor into high temperature high pressure vapor, and the vapor is transformed into liquid by heat exchange (i.e. heat release) with outdoor air at a condenser. Liquid refrigerant is expanded by heat exchange (i.e. endothermic reaction) with indoor air at an evaporator. Therefore, indoor air becomes cooler.

During the operation, moisture embedded in air is condensed by the temperature difference between an evaporator and the air, in which pressure of saturated vapor is dramatically lowered. Thus, a great quantity of condensation is formed on the evaporator. Proper process is required on the condensation due to the possibility of indoor contamination.

In a prior art, draining method is commonly adapted in that condensation is collected in a separate container and the collected condensation having a predetermined volume is infused into a drain pipe. It pays closed attention for condensation not to overflow form a container. Frequent dump of condensation accompanies great inconvenience in air conditioner use.

In these days, forcible drain method is commonly used in that a drain pipe is connected to a drain pan, which collects condensation, and a pump discharges the condensation. By using the forcible drain, condensation can be drained in easy and certain. It, however, leads a problem in that a drain pump must run continuously during an operation of an air conditioner. This increases the indoor unit noise and power consumption.

On the hands, the present applicant discloses an automatic drain apparatus of condensation using atmospheric pressure in Korean Utility Model Registration No. 0231674. In this technology, as condensation fills in a water tank in a maximum level, a water supplying pump runs for a while for the condensation to feed into a siphon. A siphon action starts when a siphon is filled with condensation. The siphon action continues owing to a water level control tank provided at an outlet of the siphon. Therefore, the condensation is discharged with no power.

This technology has an advantage in that a water supplying pump runs at one time during the operation of an air conditioner. A water level control tank, however, must be accurately installed at the predetermined level point with relative to the water level of a water supplying tank. This installation is very difficult and it is hard to anticipate the precise installation. Even after an installation of the cited apparatus is made, when an external force is applied to the exposed siphon, the level of a water level control tank is out of position and the siphon action is not accomplished smoothly.

Furthermore, the automatic draining apparatus that is working spontaneously is disclosed in Korean Utility Model Registration No. 0329477 and Japanese Laid Open Publication No. Heysei 10-339465. In this technology, the water level sensor detects the maximum level of condensation and a signal sends to the water supplying pump. The pump runs spontaneously and the siphon action starts to discharge the condensation. It has an advantage of an installation. However, since the pump must be operated spontaneously, it has a disadvantage of noise and electrical consumption. Furthermore, it has a problem in that the water supplying pump must be required to fill condensation to a siphon.

Discharge problem of condensation is not just limited to an air conditioner, but in the use of a dehumidifier, it must be accompanied in its characteristic. Therefore, discharge of condensation is one of the most important primary issues to many apparatus for generating condensation.

SUMMARY OF THE INVENTION

It is an object of the present invention to provide an automatic apparatus of condensation for dam to solve various problems being exposed in the prior art, in which condensation is pumped by the buoyancy of the condensation to fill the siphon, and condensation is fully discharged with no energy and no noise. It doesn't require a water supplying pump and a water level sensor.

In order to accomplish those and these objects, it has characteristic in that the present invention is comprised of a water tank for holding condensation; a float floating on the surface of the condensation and moving up/down along the level of the condensation; a hydraulic pressure chamber consisting of a hollow room and a check valve, the hollow room having a volume changeable area for containing the condensation, the check valve provided at an inlet of the hydraulic pressure chamber, and the check valve allowing the condensation to flow only into the hollow room, the hydraulic pressure chamber being placed on the bottom of the water tank, the float moving up along the rising of the condensation and pulling up the hydraulic pressure chamber so that the volume of the hollow room is reduced and the condensation of the hollow room is pressurized; and a siphon having an inlet connected to the hydraulic pressure chamber and the inlet being functioned as an outlet of the hydraulic pressure chamber, and an outlet being provided at outside and a level of the outlet placing at a lower level of the inlet, the siphon draining the condensation in the water tank into the outside when the siphon is filled with the condensation by the condensation discharge from the compressed hydraulic pressure chamber.

Furthermore, it has another characteristic in that the automatic draining apparatus further comprises a tower and a push rod, the hydraulic pressure chamber is vertically provided at the hole of the float and slides along the hole of the float, the tower pulls up the hydraulic pressure chamber that falls down from the hole of the float, and the push rod is extended down perpendicular to the center of the water tank, pushes down the hydraulic pressure chamber being raised with the float so that the volume of the hollow room of the container is reduced.

Furthermore, it has another characteristic in that the hydraulic pressure chamber comprises a volume changeable container having an area for containing condensation, a base provided at a bottom of the container, and a resilient member provided under the push rod for contracting/expanding the container along the up/down movement of the float.

Furthermore, it has another characteristic in that hydraulic pressure chamber is comprised of a volume changeable container; a base provided at the bottom of the container; and having a water channel interconnecting to the base, an outlet of the water channel being connected to the siphon, and an inlet of the water channel being connected to the check valve; a coil spring for maintaining the container in the expanded state; and a second check valve that is provided at a top of the container, which allows only the inflow of air, but blocks the discharge of condensation.

Furthermore, it has another characteristic in that the hydraulic pressure chamber is comprised of a cylinder interconnecting to the inlet of the siphon and having the check valve around the bottom edge, a piston provided in the cylinder to move up/down, a piston rod that is attached to the piston, extended upward, and having a flange at the end, and plural spring holders that are protruded from the top of the wall of the hole of the float in a predetermined angle interval, and that elastically clamp/released the flange of the piston rod along the up/down movement of the float.

Furthermore, it has another characteristic in that the hydraulic pressure chamber is comprised of a volume changeable container having an area for containing condensation and placed on the floor of the water tank horizontally, an having a resilient force along the expansion direction; a base provided at the one end of the container and fixed to the floor of the water tank; and a wire connecting between the free end of the container and the float along a certain path and pulling the free end of the container for making the container pressed according to the up movement of the float.

Furthermore, it has another characteristic in that the hydraulic pressure chamber is comprised of a cylinder having an area for containing condensation and placed on the floor of the water tank horizontally; a piston that is disposed in the cylinder and has a resilient force along the expansion direction of the area; and a wire connecting between the piston and the float along a certain path and making the area pressed according to the up movement of the float.

According to the present invention—an automatic draining apparatus for condensation, without providing the water pump and the water level sensor, the condensation in the water tank can be automatically pumped by the buoyancy, and can be filled in the siphon. The condensation can be discharged with no power and no noise. Therefore, the present invention has superior effect in the reliance, silence and improving convenience of the apparatus (e.g. an air conditioner or a dehumidifier) that generates the condensation during the operation.

BRIEF DESCRIPTION OF DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
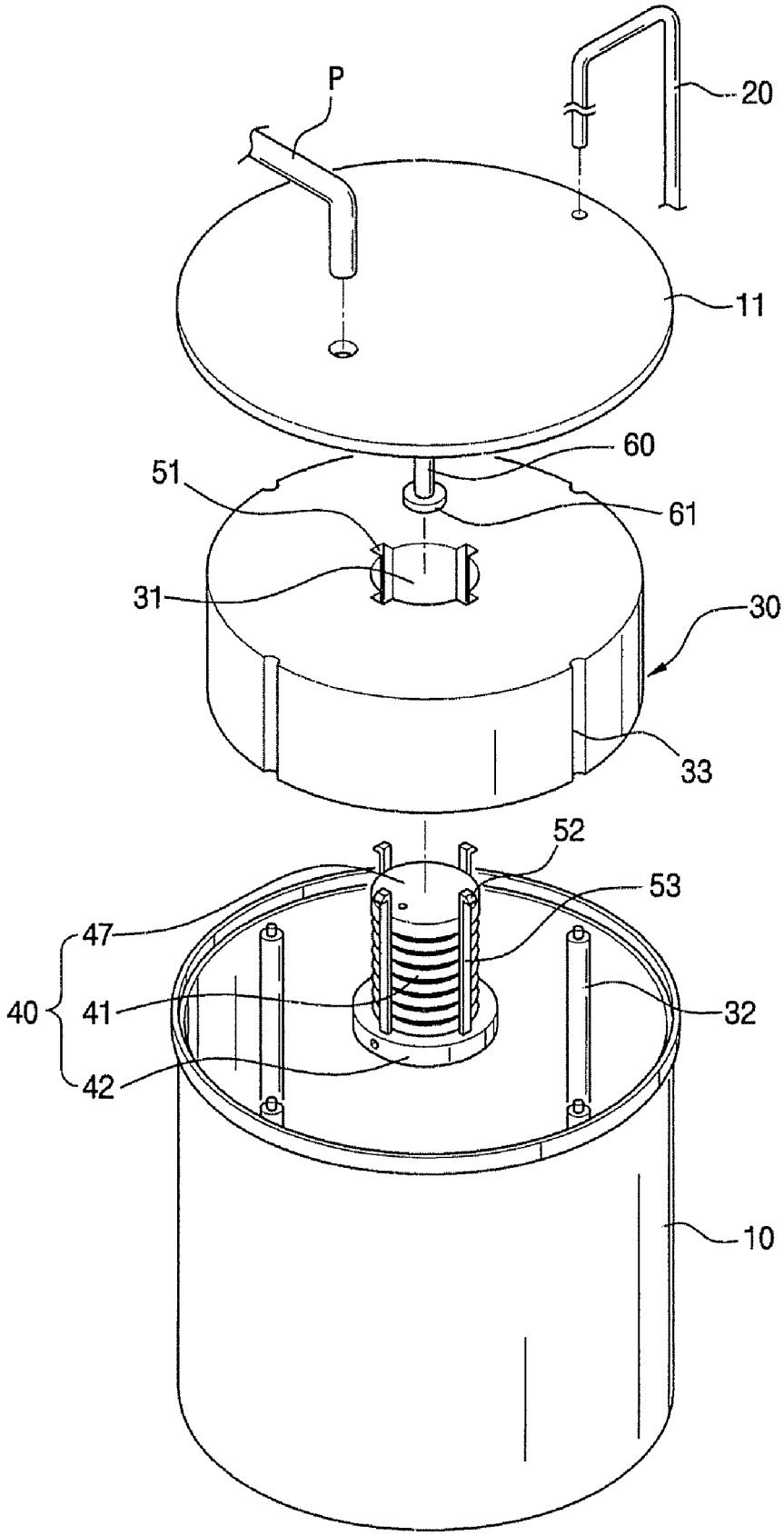
FIG. 1 is a disassembled perspective view of an automatic drain apparatus of condensation according to first embodiment of the present invention.
Figure 2:
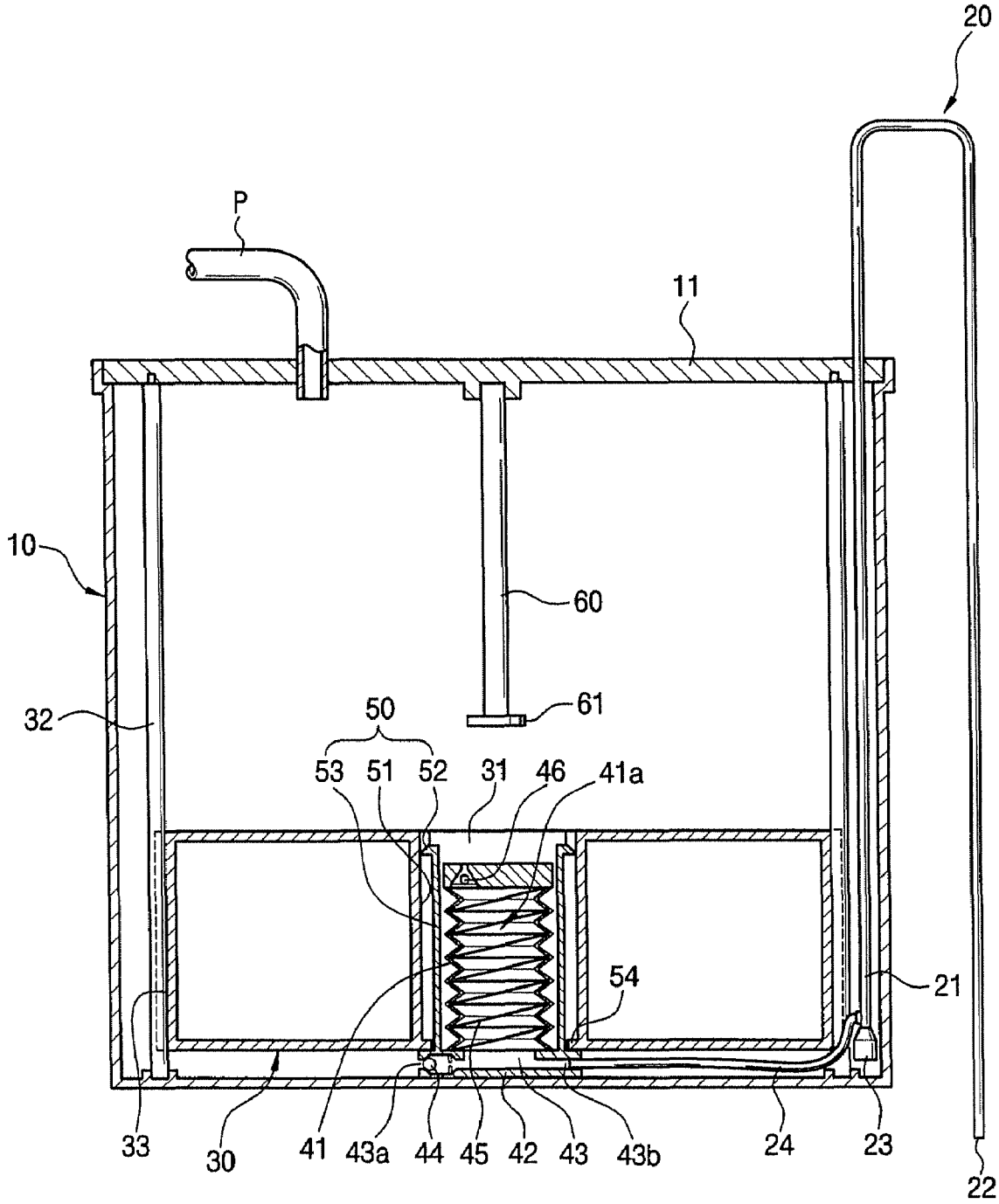
FIG. 2 is a sectional view of FIG. 1.
Figure 3:
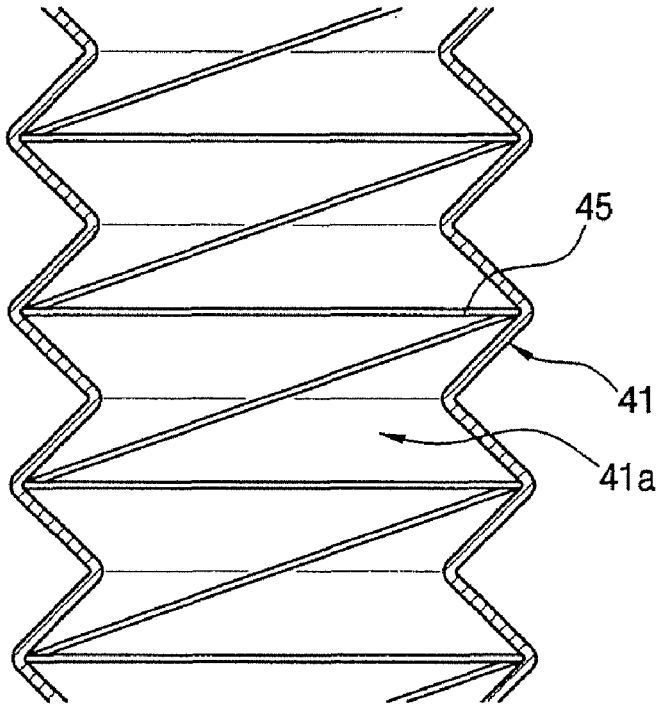
FIG. 3 is a sectional view of a hydraulic pressure chamber.

This invention will be described further by the way of exemplary embodiments with reference to the accompanying drawings.

FIGS. 1 to 6 show a first embodiment of an automatic draining apparatus according to the present invention. The automatic draining apparatus is comprised of a water tank 10 for holding condensation produced from the evaporator of an air conditioner (not shown), a siphon 20 for draining condensation contained in the water tank 10 to the outside, and a float 30 floating on the surface of the condensation and having a hole 31 at its center. Furthermore, the automatic draining apparatus is comprised of a hydraulic pressure chamber 40 which has a specific gravity the same as water, sliding through a hole 31 of the float 30, moved up by the rising movement of the float 30 when condensation "W" flows into the water tank 10, making the condensation "W" in the hydraulic pressure chamber 40 pressurized, and discharging the condensation into the siphon 20. Furthermore, the automatic draining apparatus is comprised of a tower 50 to pull up the hydraulic pressure chamber 40 that falls down from the hole 31 of the float 30 when the float 30 rises up with the water level of condensation "W". Finally, the automatic draining apparatus is comprised of a push rod 60 for pushing down the hydraulic pressure chamber 40 being raised along the float 30.

Figure 24A:
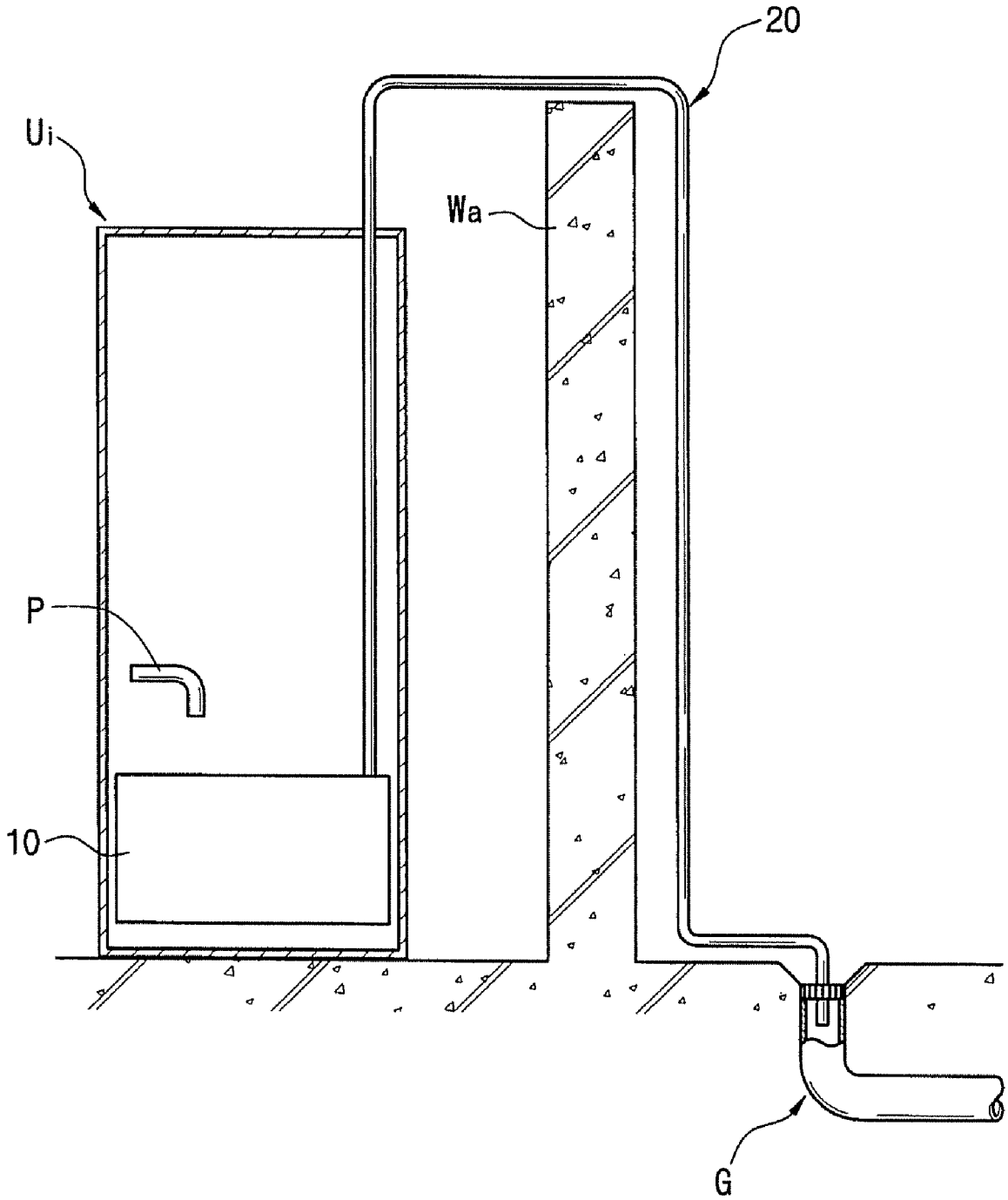
FIGS. 24*a* to 24*c* are sectional views showing an automatic drain apparatus of condensation adapted to an air conditioner.
Figure 24B:
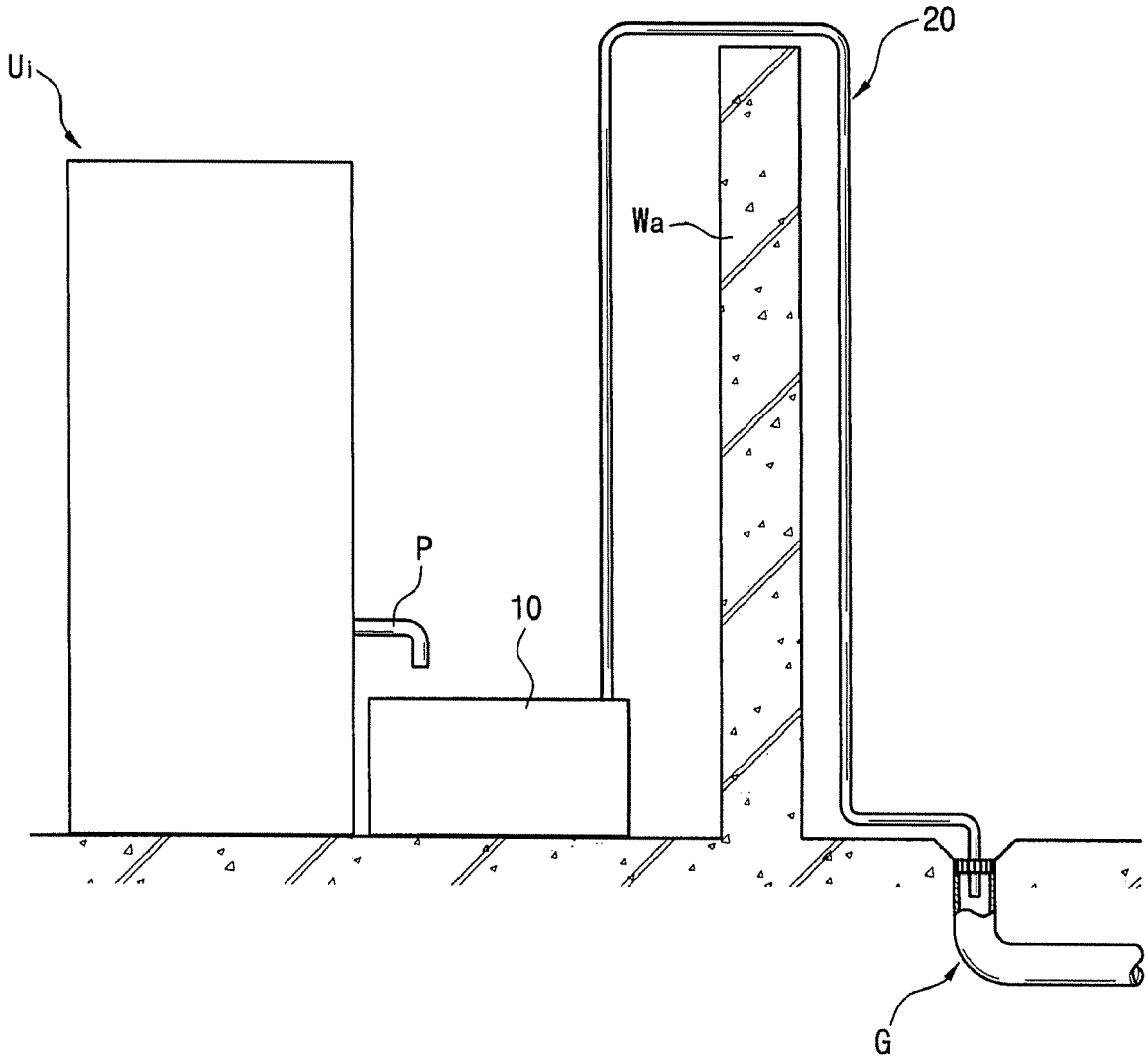

The water tank 10 has a predetermined depth so that it allows the float 30 to move up to a certain height, and has a cover 11 for covering the upper opening of the water tank 10. The water tank 10, as shown in FIGS. 24*a* and 24*b*, can be installed on either the exterior or the interior of the indoor unit "Ui". For instance, it is preferred that the water tank 10 is installed on the interior of the indoor unit "Ui" when the air conditioner is newly located or installed on the exterior of an indoor unit "Ui" when this system should be adapted to an already existing air conditioner.

Figure 24C:
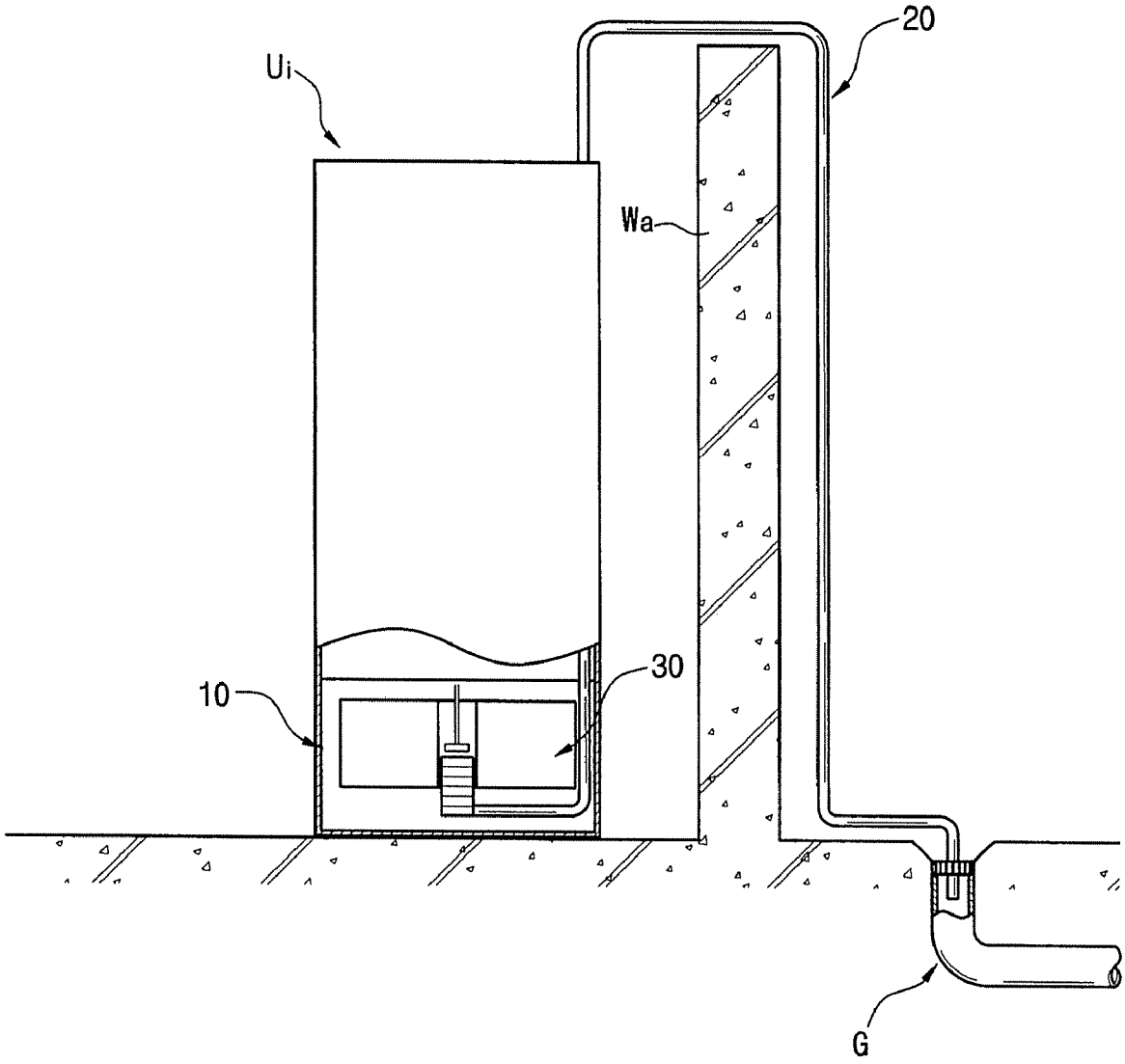

Furthermore, in the case of the interior installation, as shown in FIG. 24*c*, the inside space of an indoor unit "Ui" can be divided horizontally into two, and it is possible that the lower space can be used as an area that houses the water tank 10.

The siphon 20 is bent in the shape of an inverse "U" and extends over a wall "Wa" or passes through a wall "Wa". The inlet 21 of the siphon 20 is placed at a predetermined depth in the water tank 10 on the inside. The outlet 22 on the outside is located at a lower level than that of the inlet 21 in order to execute a siphoning operation. The outlet 22 could be extended into a drain hole "G". The siphon can be made of a conventional hard pipe. However, it is preferred that the siphon is made of a flexible pipe having a predetermined length, so that the pipe can be installed easily according to the structural condition of the installation location.

The float 30 can be configured in many forms, and is made of synthetic resin having specific gravity as the same as water. However, it is ideal to have a hollow inside so that it can be buoyant enough even with little condensate water. This allows the float 30 to move up at the same rate as the inflow of condensation into the water tank. Also, as specified later, the float 30 can press the hydraulic pressure chamber 40 by its own weight when the float 30 falls down as the condensation "W" is discharged by the siphon operation.

The float 30 has the hole 31 in the center of the float 30 so that the hydraulic pressure chamber 40 can be fitted into the hole 31. Furthermore, several vertical guiders 32 can be provided around a wall of the water tank 10 so that the float 30 moves up or down along the guider 32.

To get smooth movement of the float 30, numerous grooves 33 can be provided at the perimeter of the float 30 at a certain interval for allowing room for the guider 32. Both ends of each guider 32 are connected to the bottom and the top of the water tank 10, respectively, in order to stabilize the up/down movement of the float 30.

The hydraulic pressure chamber 40 is comprised of a volume changeable container 41 having an area 41*a* for containing the condensation "W" and a base 42 provided at a bottom of the container 41 and having a first check valve 44 disposed at the water channel 43 interconnecting to the area 41*a*. Furthermore, the hydraulic pressure chamber 40 is comprised of a coil spring 45 to maintain the container 41 in the expanded state and a second check valve 46 disposed at a top of the container 41 and allowing an air to flow into, but not allowing the water to discharge from the container 41.

Any form can be acceptable for the container 41 that can give pressure to the condensation "W" flowing into the area 41*a* and can provide a volume change due to its compression. For instance, it can be made of flexible vinyl or it is more ideal to be made of synthetic bellows pipe as shown in Figures to get excellent volume change. The head 47 having a hard characteristic is provided at the top of the container 41, so as to execute excellent compression of the container 41 by the contact of the push rod 60.

It is preferred that the base 42 has a little heavier specific gravity than that of water so that the condensation fills the area 41*a* of the container 41. That is, the condensation "W" can not flow into the area 41*a* in the case that the hydraulic pressure chamber 40 moves up following the rising of the float 30 from the initial time of the inflow of the condensation "W". Therefore, only the float 30 moves up at the beginning of the flow of the condensation "W", and the hydraulic pressure chamber 40 is still immersed in the condensate water. Thus, the condensation "W" fills in the area 41*a*.

A water channel 43 of the base 40 is connected to the area 41*a* so that the condensation "W" can flow into the container 41. The inlet 43*a* of the water channel 43 has a first check valve 44 which allows only the inflow of the condensation "W". An outlet 43*b* of the water channel 43 is connected to the inlet 21 of the siphon 20.

Figure 6:
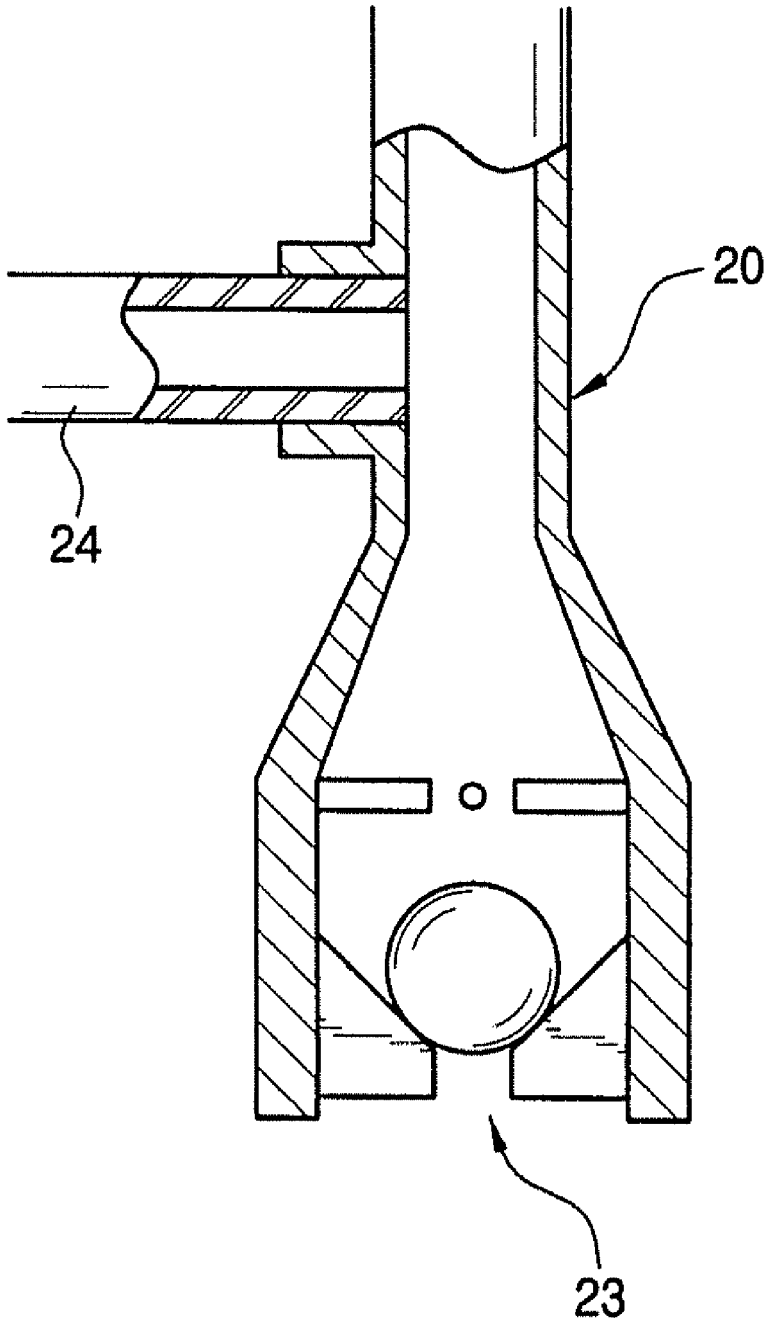
FIG. 6 is an enlarged view of a third check valve of FIG. 2.

In the connection between the outlet 43*b* of water channel 43 and the inlet 21 of the siphon 20, the inlet 21 of the siphon 20 can be extended to connect to the outlet 43*b* of the water channel 43. Otherwise, as shown in FIG. 6, a third check valve 23 is provided at the inlet 21 of the siphon 20, which allows the only inflow of the condensation "W" from the siphon 20. Operation of the third check valve 23 is the same as that of the first check valve 44. Furthermore, additional pipe 24 is employed to connect the upper line of the third check valve 23 and the water channel 43 of the base 42.

Figure 4:
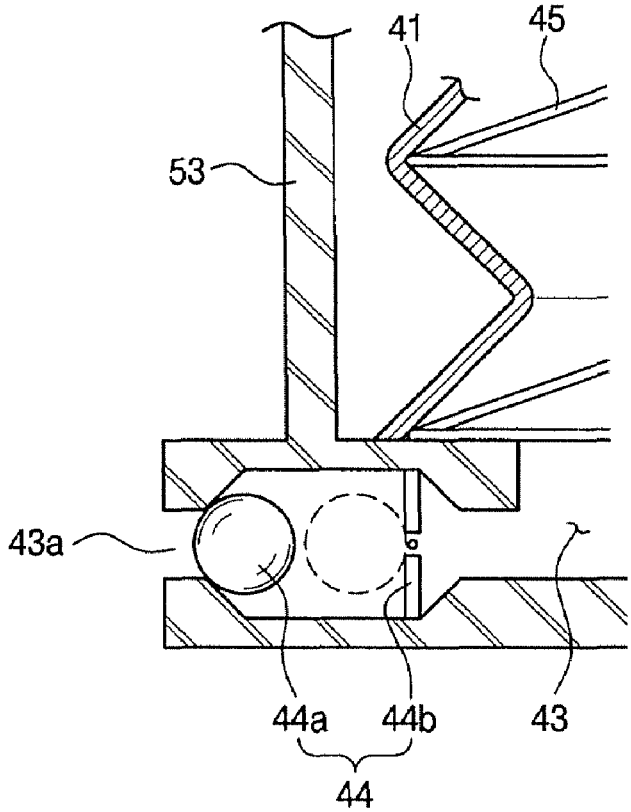
FIG. 4 is an enlarged sectional view showing a first check valve of the hydraulic pressure chamber.

The individual first check valve 44 can be installed at the water channel 43. Or, as shown in FIG. 4, some part of the water channel 43 is expanded. A valve ball 44*a* and several ball supporters 44*b* can be installed in the expansion area of the water channel 43.

A coil spring 45 has a predetermined elasticity that is smaller than deadweight of the float 30 so that the container 41 can collapse under the deadweight of the float 30. At the same time, the coil spring 45 has a smaller elasticity than the buoyancy of the float 30 so that the coil spring 45 can collapse due to the rising float 30.

There is no specific drawing for such a coil spring 45 in here. It goes without saying that the coil spring 45 can be easily integrated into the container 41 when the container 41 is molded.

Figure 5A:
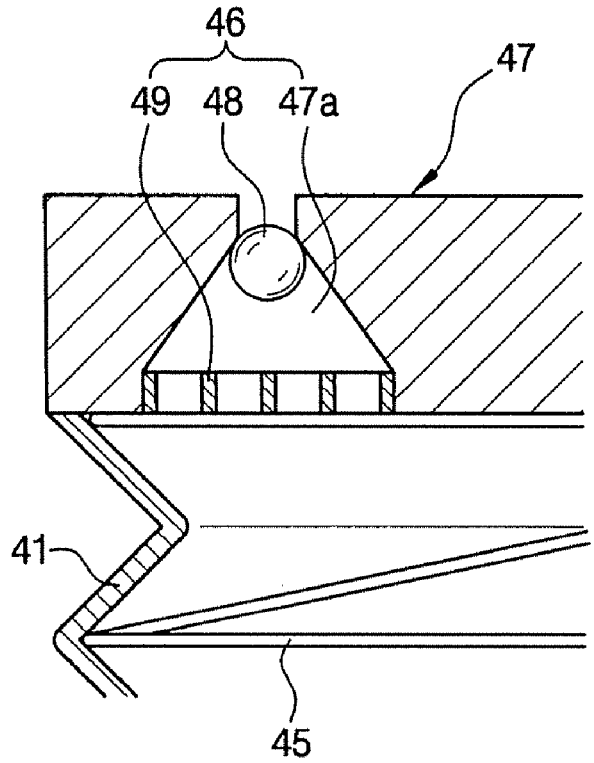
FIGS. 5*a* and 5*b* are enlarged sectional views showing the operation of a second check valve.
Figure 5B:
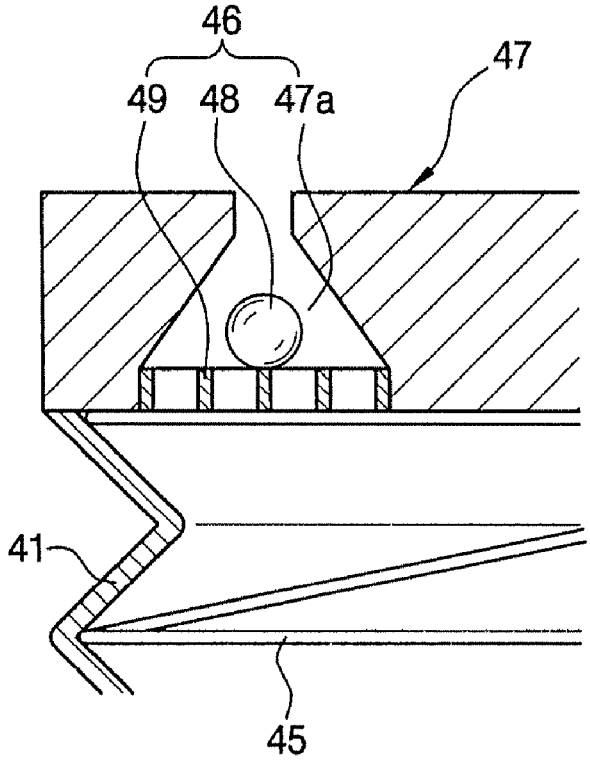

The second check valve 46 is comprised of a valve housing 47*a*, a valve ball 48 and a ball supporter 49 as shown in FIGS. 5*a* and 5*b*. The valve housing 47*a* is configured in the head 47 of the container 41 so as to house the valve ball 48 and the ball supporter 49. The valve ball 48 has a predetermined specific gravity that is larger than that of air and smaller than that of water. The ball supporter 49 has a grill shape so as not to lose the valve ball 48 out from the valve housing 47*a*.

In the second check valve 46, the air in the container 41 escapes from the container 41 by the condensation "W" flowing into the container 41. Thus, the condensation "W" can easily flow into the area 41*a* of the container 40.

The tower 50 is comprised of many guide grooves 51 and the supporter 53. Each guide groove 51 is created in a vertical manner around the hole of the float 30 at a certain distance. There is a protrusion 52 at a top of the supporter 53, which slides into the guide groove 51. The bottom of the supporter 53 is fixed on the base 42 of the hydraulic pressure chamber 40.

The bottom of the guide groove 51 is blocked so as to prevent the protrusion 52 from coming out from the guide groove 51. Each supporter 53 has a protrusion 52 that extends in the direction opposite to each guide groove 51, which is provided along the circumference of the container 51. Even if it has not been described in an additional drawing, it does not matter if the supporters 53 have several protrusions 52 along the circumference of the supporters 53, and are configured in a cylinder so as to hold the container 41 in the supporters 53.

It is acceptable that the tower 50 has a rim 54 provided at the bottom of the hole 31 and a cylinder having a flange provided at the upper circumference of the cylinder.

The push rod 60 is attached to the center of the cover 11 of the water tank 10 having its one end of the push rod 60, extended down perpendicular to the cover 11. At the bottom end of the push rod 60, a stopper 61 can be provided, which has a wide cross-section so as to firmly press on the upper end of the container 41 due to the rising movement of the float 30.

The operation of the first embodiment of the automatic draining apparatus for condensation will be described herein below with reference to FIGS. 7*a* to 7*d*.

Figure 7A:
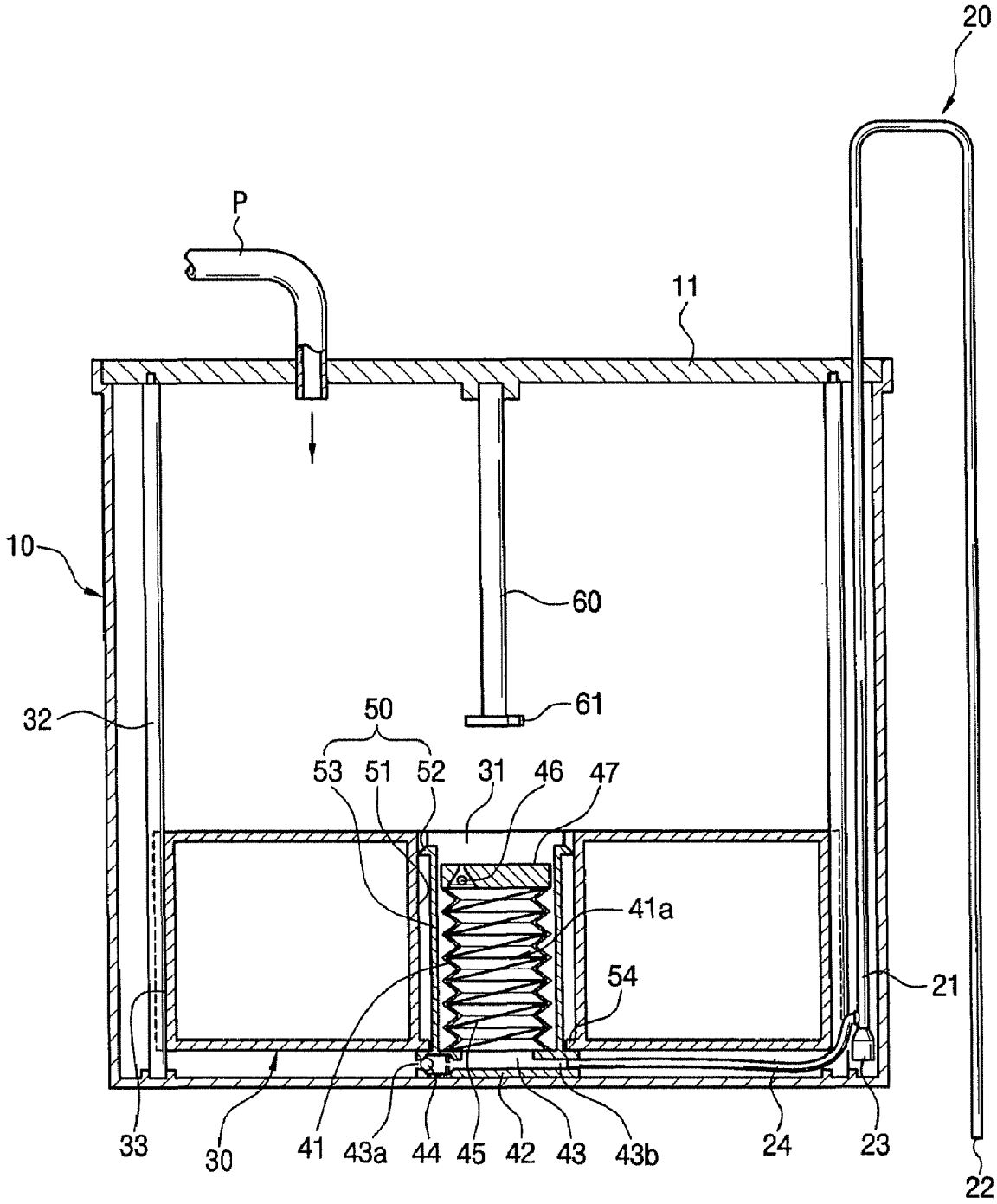
FIGS. 7*a* to 7*d* are sectional views showing operation of an automatic drain apparatus of condensation according to first embodiment of the present invention.

Firstly, as shown in FIG. 7*a*, when the air conditioner does not operate, there is no or little condensation in the water tank 10. Thus, the inside of the water tank 10 is almost empty. The float 30 assembled with the hydraulic pressure chamber 40 sits on the floor of the water tank 10. Also, the siphon 20 is empty.

In the empty state, as the air conditioner is working, condensation "W" formed on the air conditioner flows continuously into the water tank 10 via the condensation discharge pipe P connected to the drain pan (not shown) of the air conditioner.

Figure 7B:
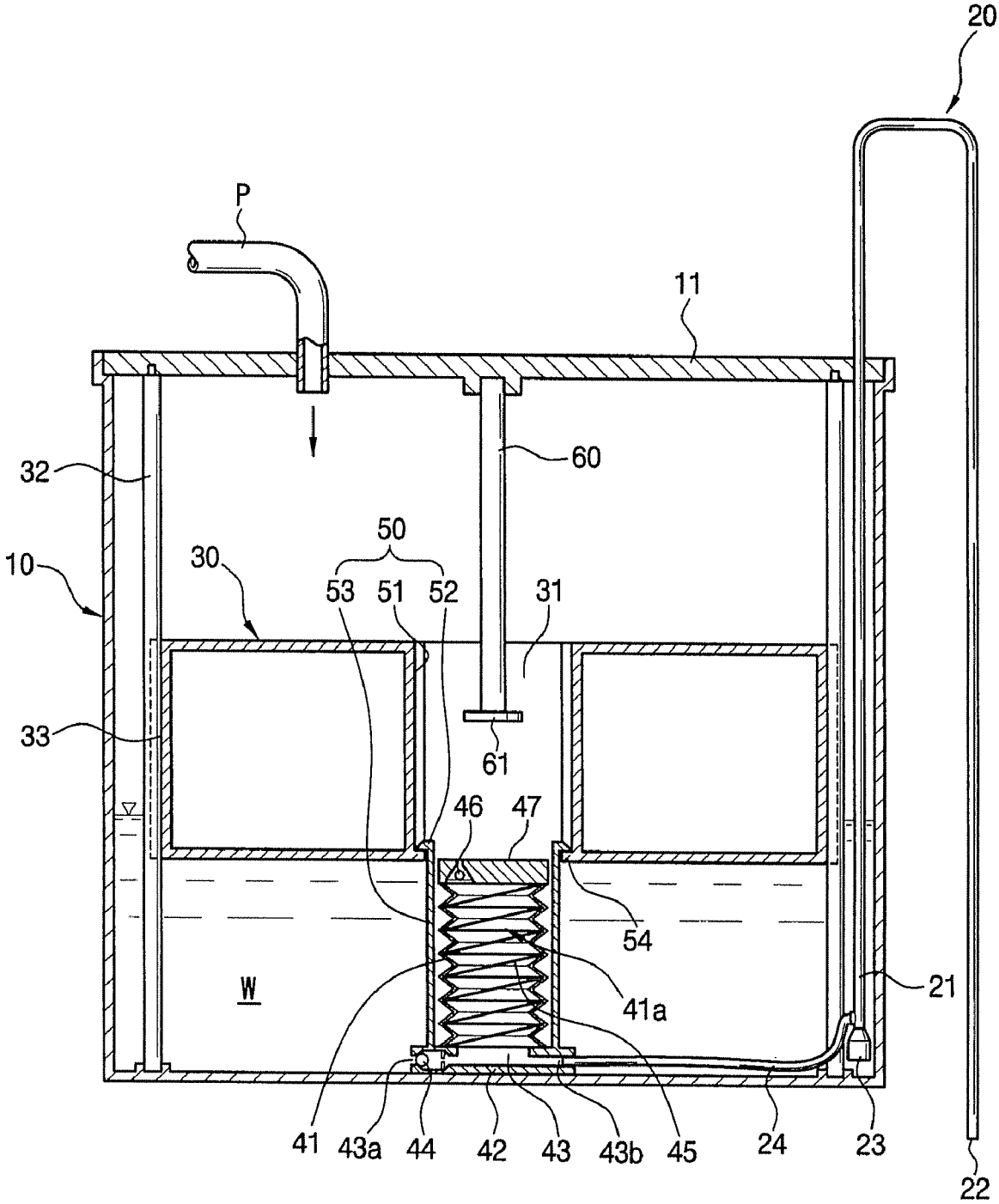

Subsequently, as shown in FIG. 7*b*, condensation "W" fills in the water tank 10 above a predetermined water level. As buoyancy is going to be greater than the deadweight of the float 30, the float 30 moves up along the guider 32 by the buoyancy of the float 30. However, the hydraulic pressure chamber 40 does not move up and still stays on a floor of the water tank 10 because the hydraulic pressure chamber 40 has a greater specific gravity than that of the water.

Next, the condensation "W" flows into the water tank 10 from the air conditioner, part of the condensation "W" flows into the container 41 via the water channel 43 that is formed in the base 42 of the hydraulic pressure chamber 40. At the same time, condensation "W" fills in the inlet 21 of siphon 20 at the same water level of the water tank 10.

At the initial state, there is no condensation in both the container 41 and the siphon 20. The first and third check valves 44, 23 are provided at the inlet 43*a*, 21, respectively (FIGS. 4 and 6) and are opened against the flow direction of condensation. Condensation "W" that comes into the water tank 10 opens the first and third check valve 44, 23 by the pressure of the water. Condensation flows into the area 41*a* of the container 41 and the siphon 20.

Since the second check valve 46 is provide in the head 47 (FIGS. 5*a* and 5*b*), which allows the air to come into, condensation "W" can fully fill in the area 41*a* of the container 41 without any resistance.

As the level of condensation "W" in the water tank 10 is going to rise, the bottom of the float 30 reaches the top edge of the hydraulic pressure chamber 40. The rim 54 provided at the lower end of the guide groove 51 contacts the protrusion 52 provided at the upper end of the supporter 53. Only the upward movement of the float 30 is resisted. At this state, the hydraulic pressure chamber 40 is locked to the float 30 that continues to move-up due to the condensation "W" continuously flowing into the water tank 40, and the hydraulic pressure chamber 40 also moves up.

Figure 7C:
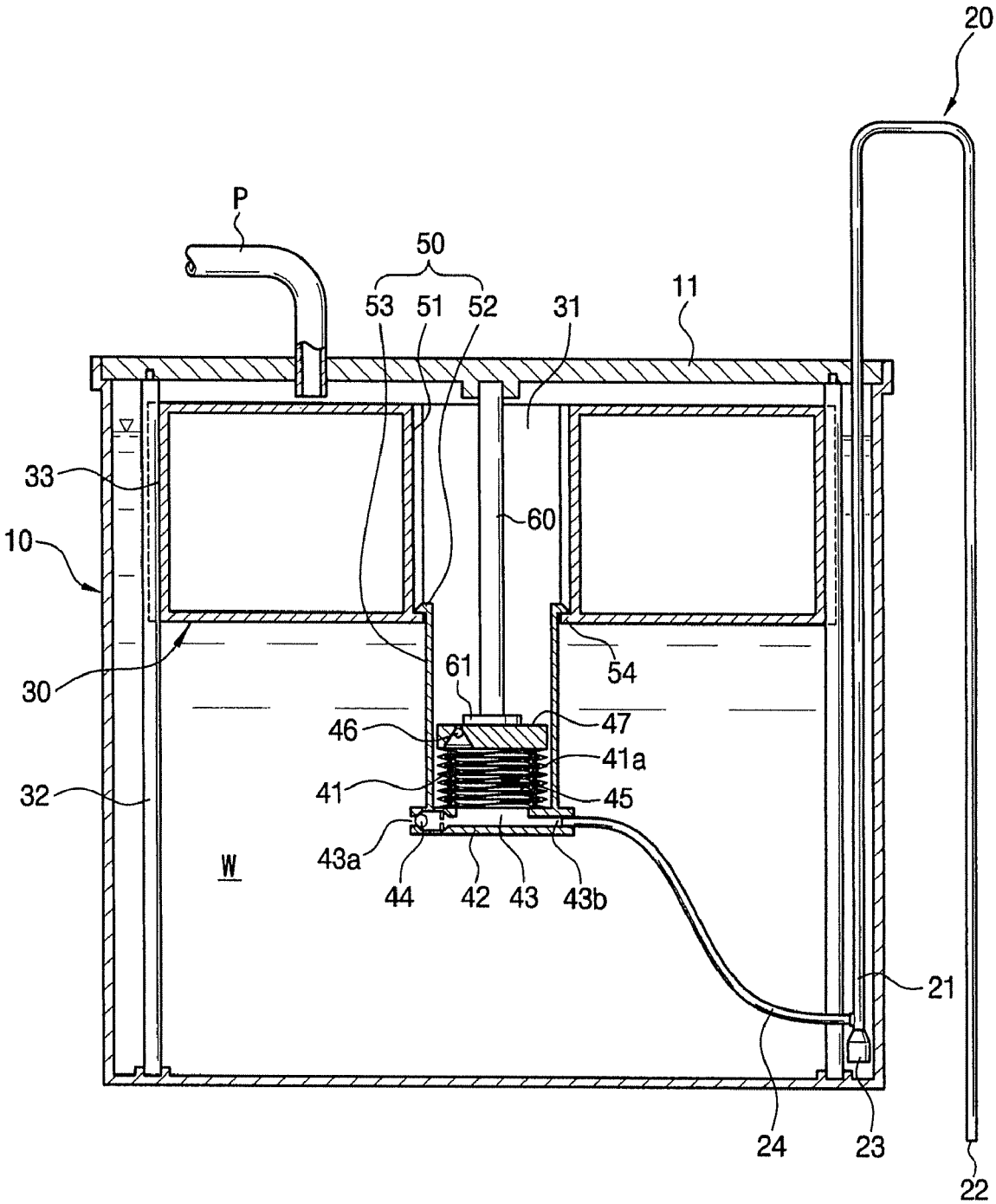

Furthermore, as the float 30 moves further up, as shown in FIG. 7*c*, the head 47 of the hydraulic pressure chamber 40 is contacted by the push rod 60 extended down from the center of the cover 11. Thus, the upward movement of the hydraulic pressure chamber 40 is resisted.

However, the float 30 continues moving up due to the continuous flow of condensation "W". The base 42 has received a pull-up force by the rising float 30 since the protrusion 52 of the supporter 53 is placed on the rim 54 of the float 30.

The hydraulic pressure chamber 40 is gradually pressed by the up-movement of the float 30. The volume of the area 41*a* of the hydraulic pressure chamber 40 is reduced and the condensation "W" in the area 41*a* is pressurized. Pressure in the area 41*a* increases and the first, second and third check valves 44, 46 and 23 are closed. That is, the valve ball 44*a* of the first check valve 43 blocks the inlet 43*a* as shown in FIG. 4, the valve ball 48 of the second check valve 46 blocks the opening of the head 47 as shown in FIG. 5*a*, and the valve ball of the third check valve 23 blocks the lower opening of the siphon 20 as shown in FIG. 6. Condensation "W" in the area 41*a* flows into the siphon 20 via the inlet 43*b* at the base 42 so as to fill the siphon 20.

After condensation "W" fully fills the siphon 20, the condensation discharge starts to the drain hole (not shown) from the outlet 43*b*. Thus, siphon operation starts. Once the pressure in the siphon 20 becomes lower than that of the water tank 10, the first, and third check valves 44, 23 open. That is, the valve ball 44*a* of the first check valve 43 moves to the ball supporter 44*b* (FIG. 4), and the valve ball of the third check valve 23 moves up from the lower opening of the siphon 20 (FIG. 6). The condensation "W" keeps discharging from the water tank 10 with no power and no noise.

By the siphon operation, condensation "W" flows in the water tank 10 from an evaporator while condensation "W" of the water tank 10 has been exhausted. Since the inflow volume of the condensation is greater than outflow relative volume of the condensation, the water level of the water tank 10 is gradually lowering.

Figure 7D:
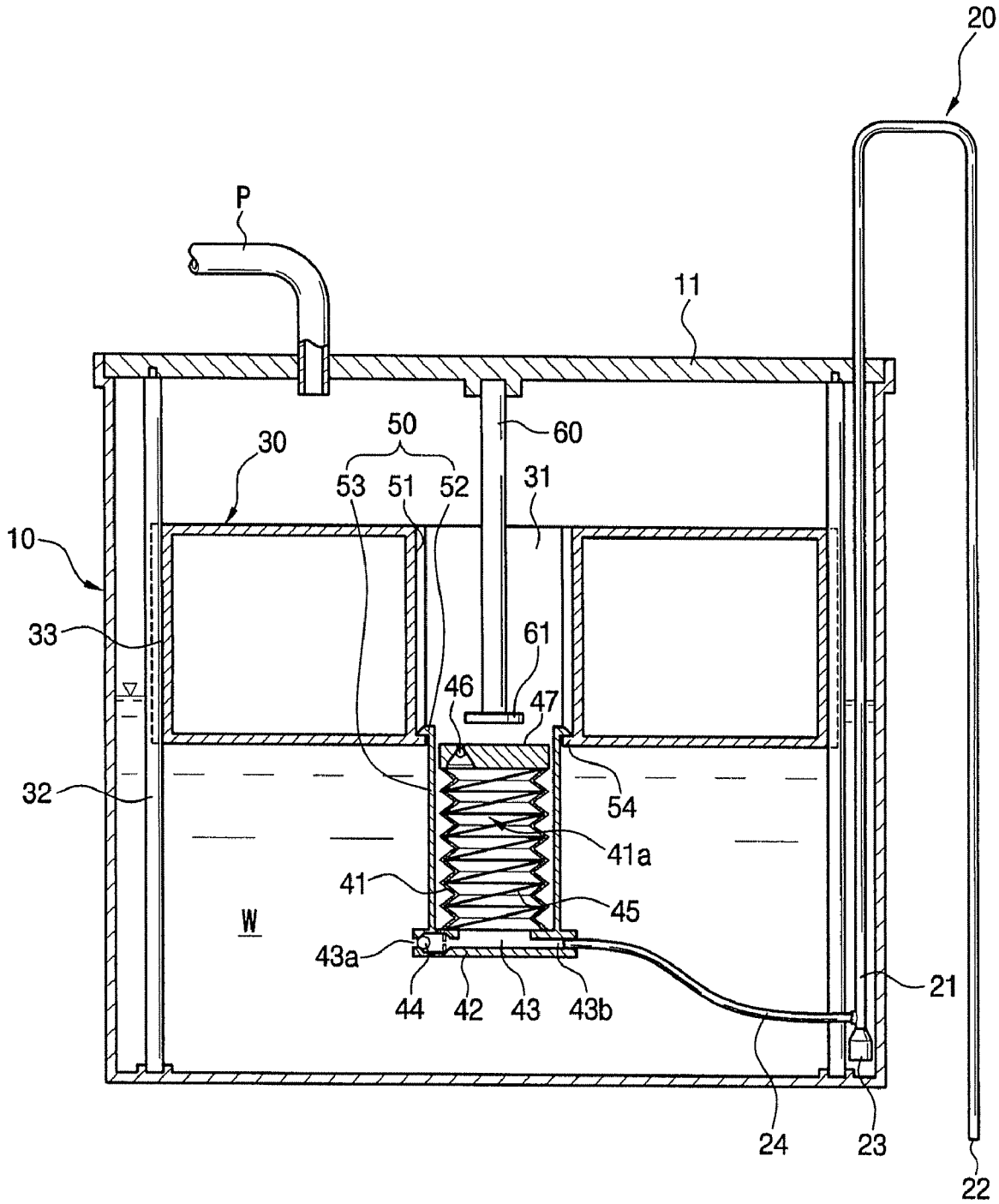

After the commencement of the siphon operation, as shown in FIG. 7*d*, the float 30 descends along with the lowing water level. The compressed container 41 expands to the first state by an elastic force of the coil spring 45 provided in the container 41.

Furthermore, the hydraulic pressure chamber 40 reaches the bottom of the water tank 10 along with the lowing water level. The float 30 moves down against the hydraulic pressure chamber 40, and finally the hole 31 of the float 30 fits around the hydraulic pressure chamber 40 as shown in FIG. 7*a*.

Most condensation "W" in the water tank 10 is discharged, and both the float 30 and the hydraulic pressure chamber 40 are placed on the floor of the water tank 10. The air of the water tank 10 comes in the siphon 20, and the siphon action suspends to also stop the exhaust from condensation "W". The inside of the siphon 20 is empty again.

As time goes by in the above state, condensation "W" flows in the water tank 10 and reaches a certain water level. As described above, the float 30 moves up again due to the buoyancy of the condensation "W". The siphon action resumes exhausting condensation "W". Therefore, the above procedure recurs during the operation of the air conditioner. Condensation "W" can be automatically and fully discharged with no power and no noise.

Figure 8:
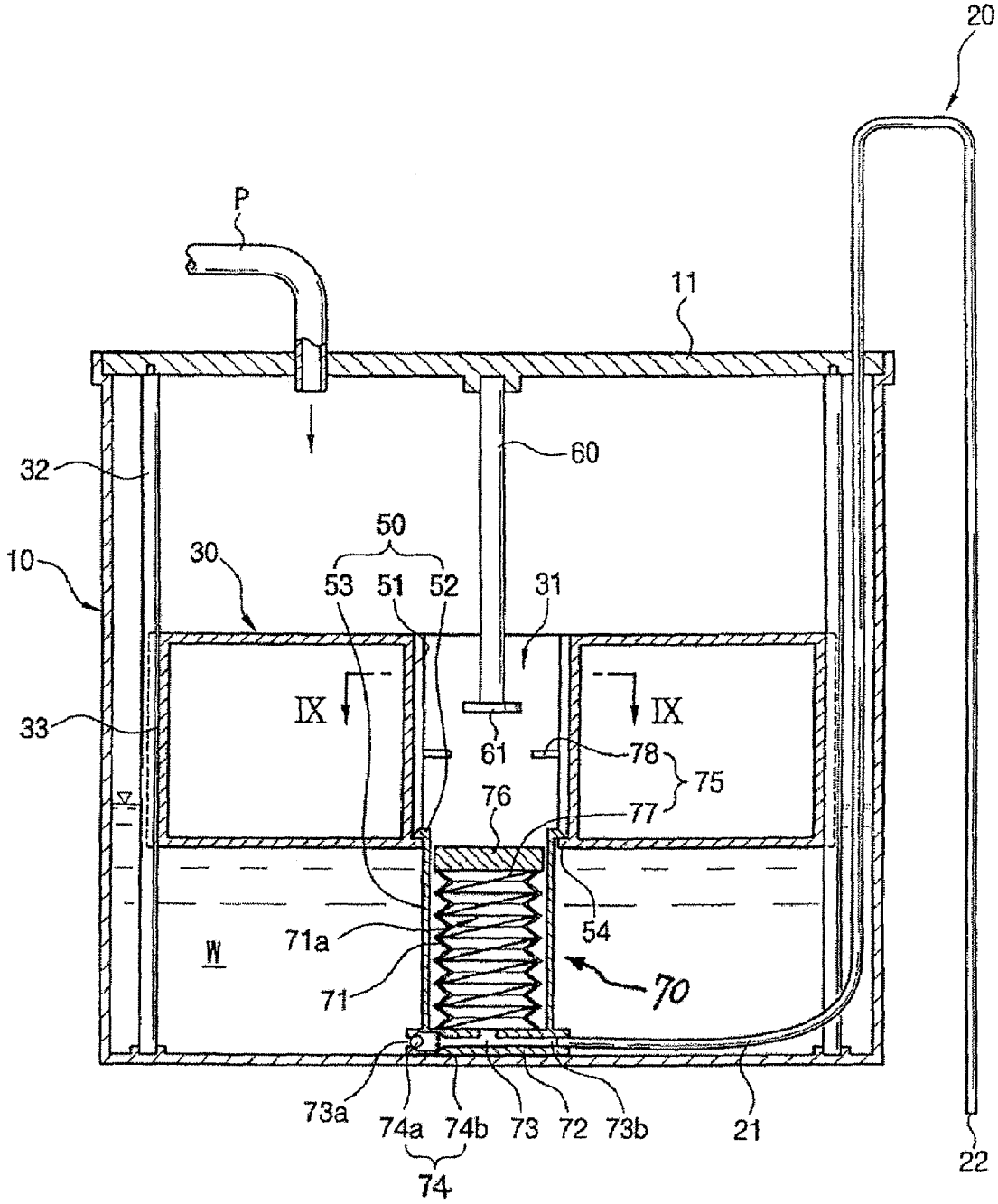
FIG. 8 is a sectional view of an automatic drain apparatus of condensation according to second embodiment of the present invention.
Figure 9:
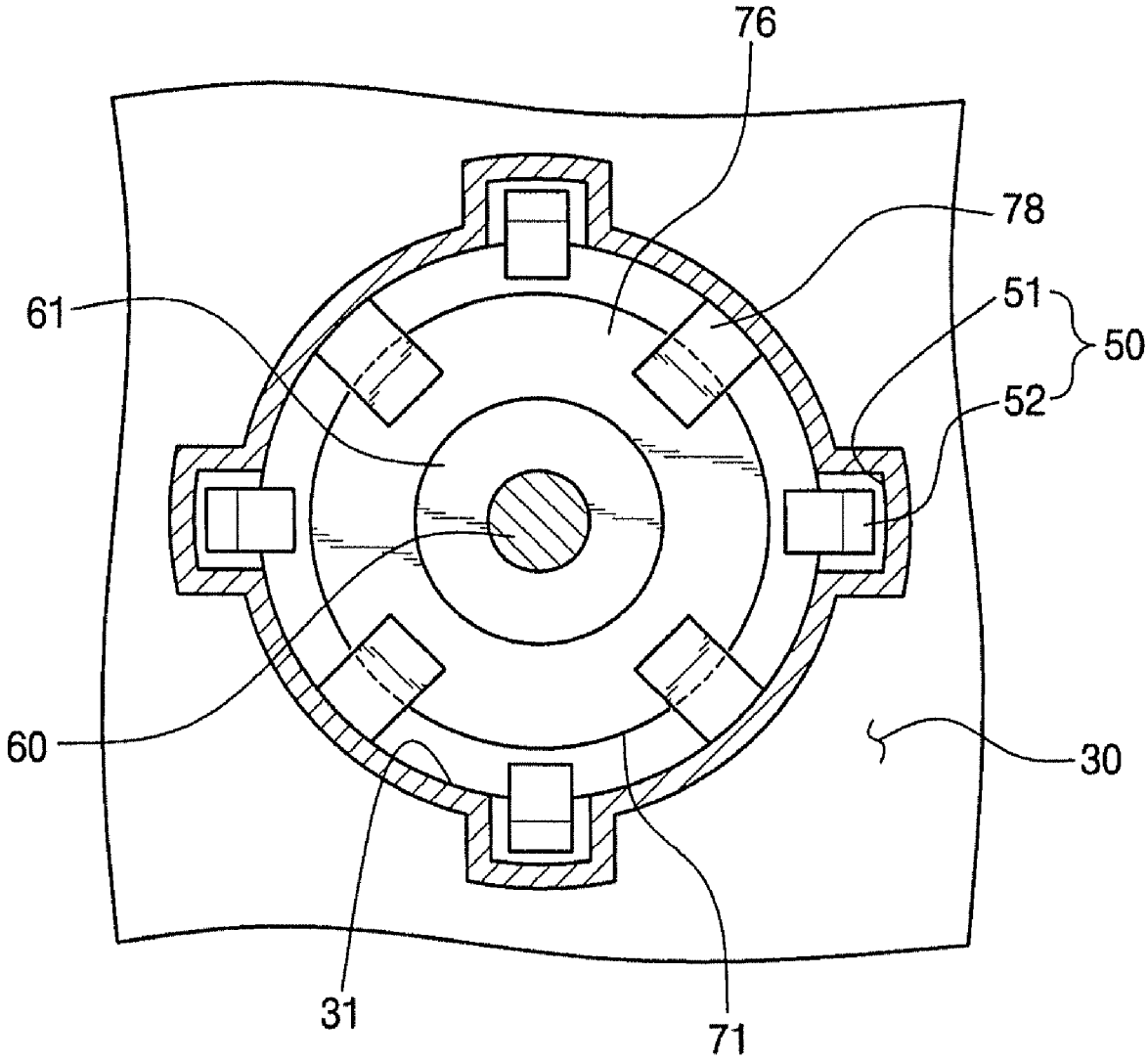
FIG. 9 is a sectional view along line IX-IX of FIG. 8.

FIGS. 8 and 9 show a second embodiment of an automatic draining apparatus according to the present invention. In addition to the components of the first embodiment, a hydraulic pressure chamber 70 is comprised of a volume changeable container 71 having an area 71*a* for containing the condensation "W" and a base 72 provided at a bottom of the container 71 and having a first check valve 74 disposed at the water channel 73 interconnecting to the area 71*a*. Furthermore, the hydraulic pressure chamber 70 is comprised of a resilient member 75 that is provided under the push rod 60 for making the container 71 pressed according to the up/down movement of the float 30.

A various form can be adapted to the container 71, which can easily be changed due to a little exterior force. It can be preferably made of flexible synthetic bellows pipe to get excellent volume change of the container 71.

The head 76 having a hard characteristic is provided at the top of the container 71, so as to execute excellent compression of the container 71 by the contact of the push rod 60.

It is preferred that the base 72 has a little heavier specific gravity than that of water so that the condensation "W" fills the area 71*a* of the container 71. A water channel 73 of the base 72 is connected to an area 71*a* so that the condensation "W" can flow into the container 71. The inlet 73*a* of the water channel 73 has a check valve 74 which allows only the inflow of the condensation "W". An outlet 73*b* of the water channel 73 is connected to the inlet 21 of the siphon.

The valve 74 can be installed at the water channel 73. Or, some part of the water channel 73 is expanded. A valve ball 74*a* and several ball supporters 74*b* can be installed in the expansion area of the water channel 73.

The resilient member 75 is comprised of a coil spring 77 disposed in the container 71 to maintain the container 41 in the expanded state, and a pusher 78 formed on the wall of the hole 31. The pusher 78 is protruded from the middle of the wall of the hole 31, and contacts on the upper rim of the head 76.

The coil spring 77 has a predetermined elasticity that is smaller than deadweight of the float 30 so that the container 71 can collapse under the deadweight of the float 30. At the same time, the coil spring 77 has a smaller elasticity than the buoyancy of the float 30 so that the coil spring 77 can collapse due to the rising float 30. It goes without saying that the coil spring 77 can be easily integrated into the container 71 when the container 71 is molded.

The pusher 78 is comprised of four members that are provided in the hole 31 of the float 30 in a predetermined angle interval. Each member of the pusher 78 is placed at the middle place of the adjacent guide grooves 51 (the protrusion 52) so as not to intervene the operation of the tower 50.

There is no specific drawing for the pusher 78 having other form. It goes without saying that the pusher 78 can be formed along the inside perimeter of the hole 31 of the float 30. In this case, groove can be formed at the pusher 78, through which each protrusion 52 of the tower 50 can be moved up and down, that can prevent the intervention to the movement of the tower 50.

The operation of the second embodiment of the automatic draining apparatus for condensation will be described herein below with reference to FIGS. 10*a* to 10*d*.

Figure 10A:
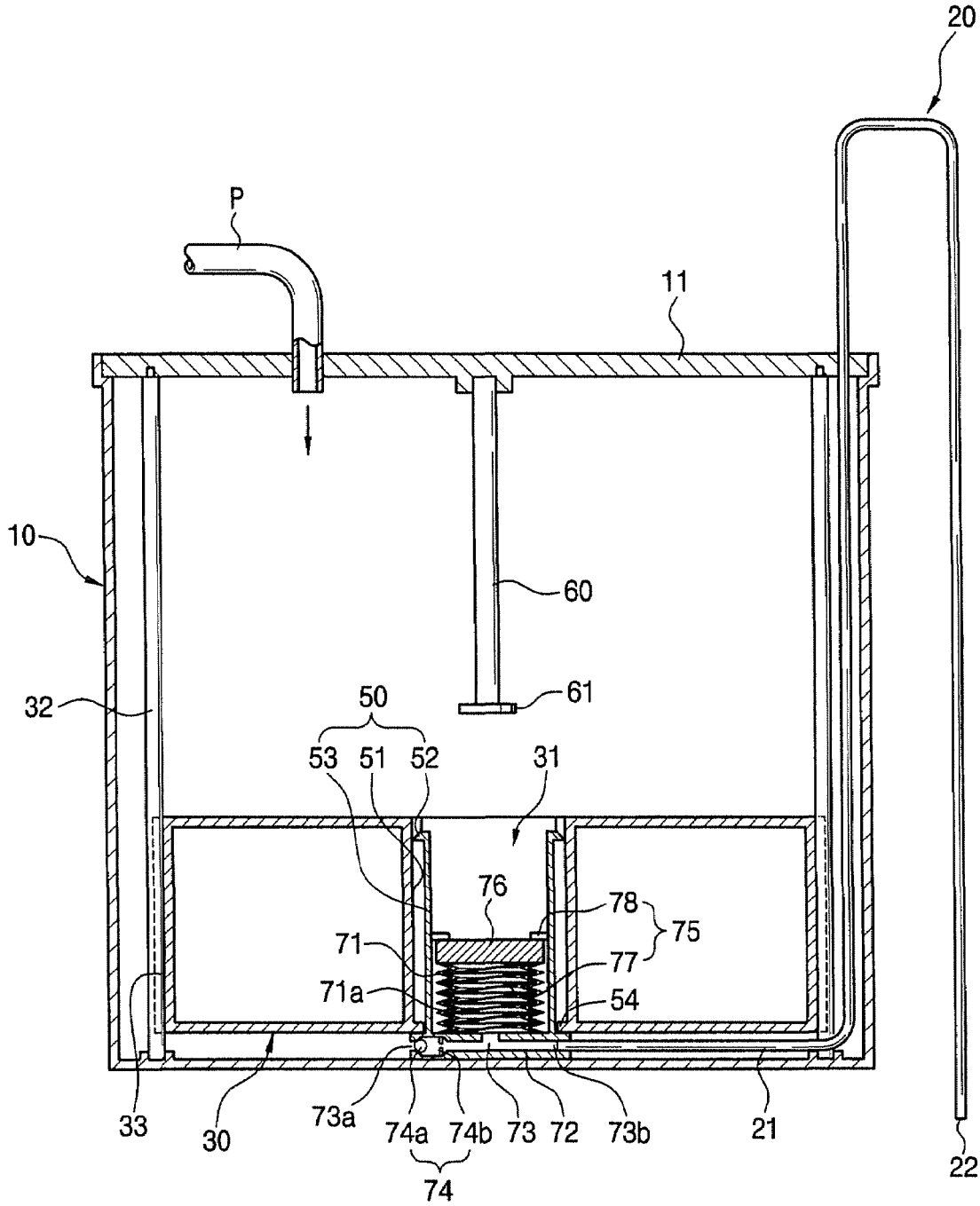
FIGS. 10*a* to 10*d* are sectional views showing operation of an automatic drain apparatus of condensation according to second embodiment of the present invention.

Firstly, as shown FIG. 10*a*, when the air conditioner does not operate, there is no or little condensation in the water tank 10. Thus, the inside of the water tank 10 is almost empty. The container 71 of the hydraulic pressure chamber 70 is pressurized by the deadweight of the float 30. The pressed container 71 puts into the hole 31 of the float 30. The float 10 assembled with the container 71 sits on the floor of the water tank 10. The siphon 20 is also empty.

In the empty state, as the air conditioner is working, condensation "W" formed on the air conditioner flows continuously into the water tank 10 via the condensation discharge pipe connected to the drain pan (not shown) of the air conditioner.

Figure 10B:
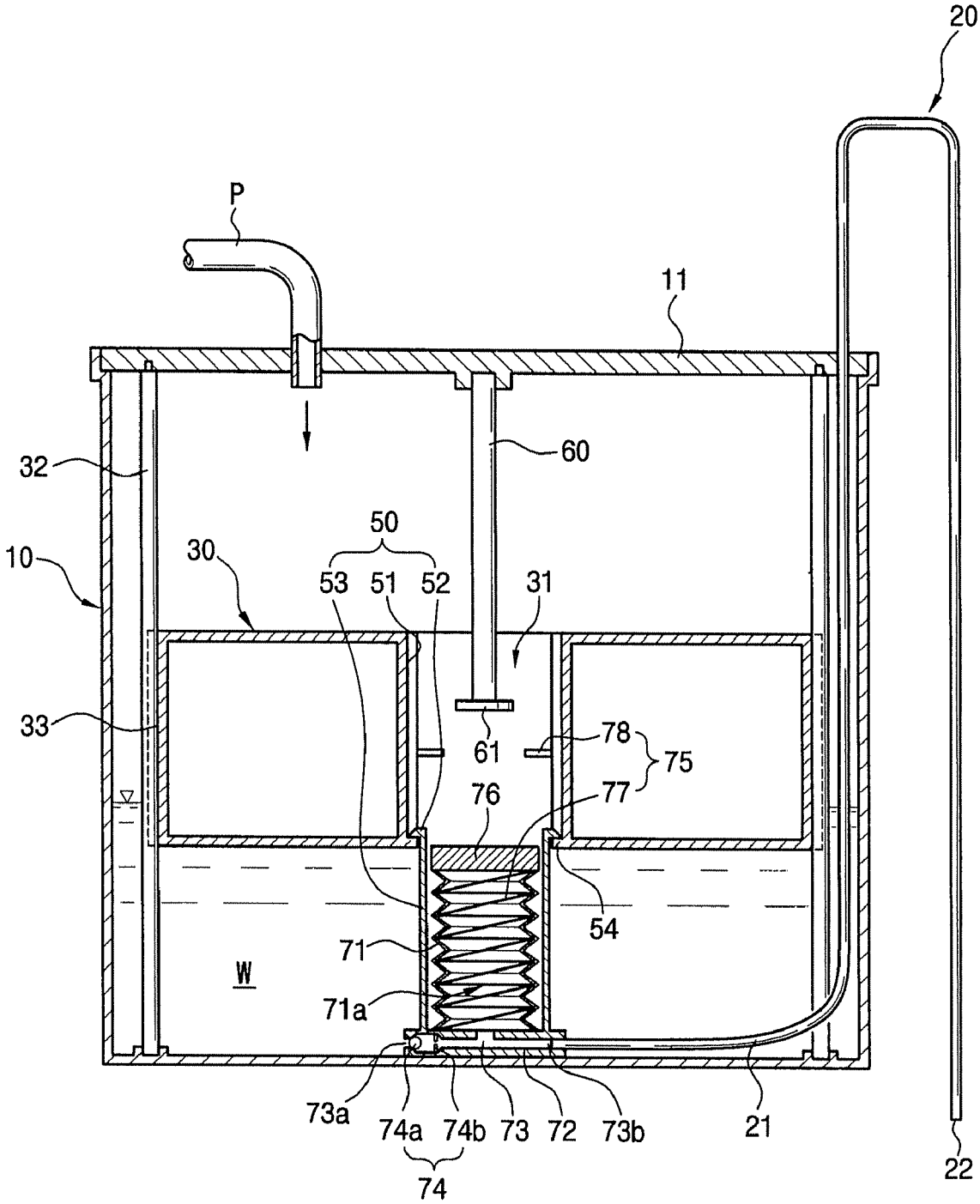

Subsequently, as shown FIG. 10*b*, condensation "W" fills in the water tank 10 above a predetermined water level. As buoyancy is going to be greater than the deadweight of the float 30, the float 30 moves up along the guider 32 by the buoyancy of the float 30. However, the hydraulic pressure chamber 70 does not move up and still stays on a floor of the water tank 10 because the hydraulic pressure chamber 70 has a greater specific gravity than that of the condensation. As the float 30 moves up, constraint to the pressed container 71 can be released. The resilient force of the coil spring 77 can spread the pressed container 71.

Part of the condensation "W" in the water tank 10 opens the check valve 74 that is provided at the water channel 73 of the base 72 and flows into the container 41. At the same time, condensation "W" fills in the inlet 21 of the siphon 20 at the same water level of the water tank 10.

There is the pressurized air of the container 71 at the upper space of the area 71*a*. Thus, condensation "W" can not completely fill in the container 71, by which a little of no-water area is formed. It can solve the capability design of the container 71 with respect to volume of the siphon 20. Little effect is given on the functionality of the prevent invention.

As the level of condensation "W" in the water tank 10 is going to rise, the bottom of the float 30 reaches the top edge of the hydraulic pressure chamber 70. The rim 54 provided at the lower end of the guide groove 51 contacts the protrusion 52 provided at the upper end of the supporter 53. The hydraulic pressure chamber 70 is locked to the float 30 that continues to move up due to the condensation "W" continuously flowing into the water tank 10, and the hydraulic pressure chamber 70 also moves up.

Figure 10C:
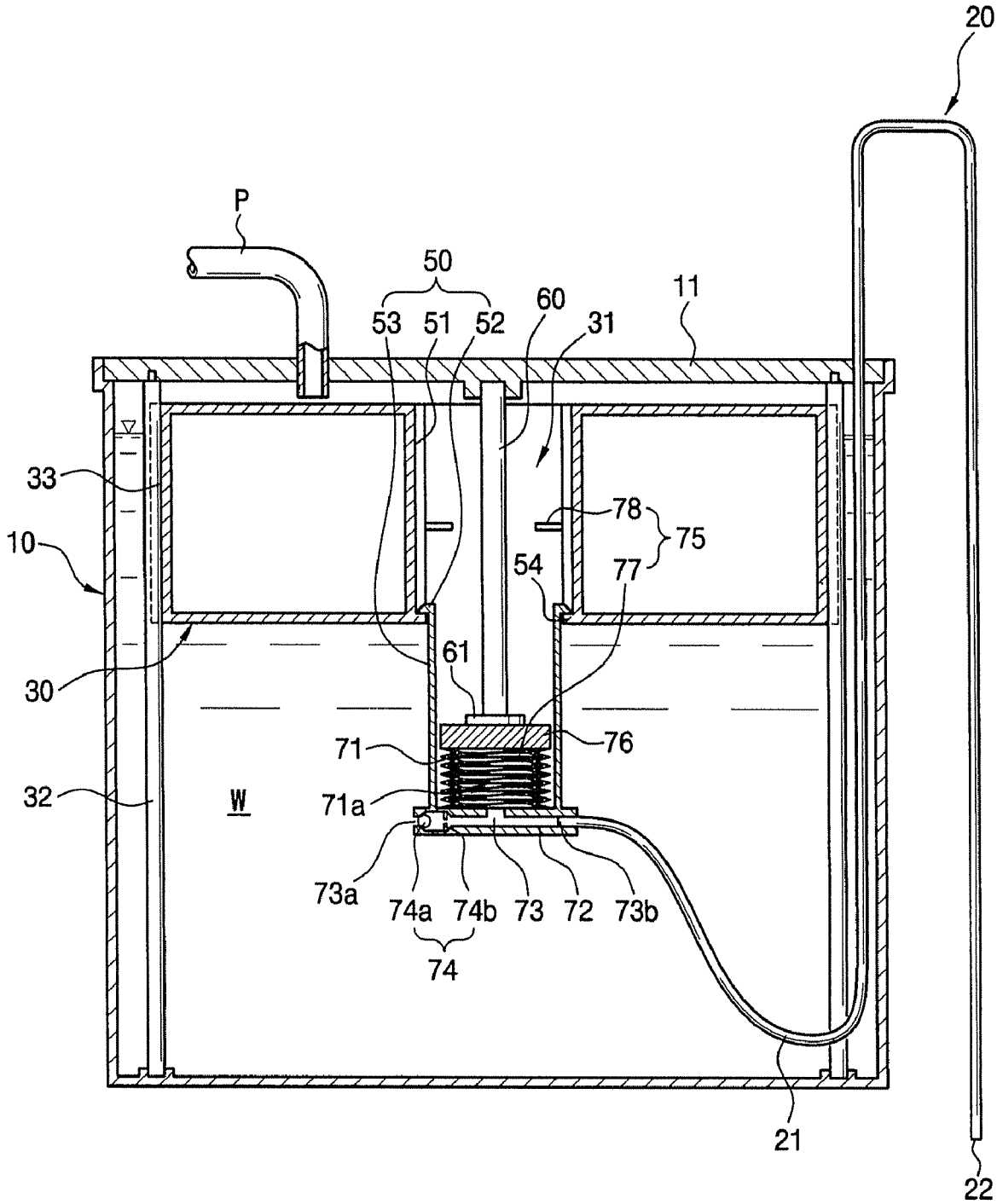

Furthermore, as the float 30 moves further up, as shown in FIG. 10*c*, the head 76 of the container 71 contacts with the push rod 60 extended down from the center of the cover 11. Thus, the push rod 60 resists the upward movement of the hydraulic pressure chamber 70. However, the float 30 continues to move up due to the continuous flow of condensation "W". The base 72 has received a pullup force by the rising float 30 since the protrusion 52 of the supporter 53 places on the rim 54 of the float 30. The hydraulic pressure chamber 70 is gradually pressed by the up-movement of the float 30. The volume of the area 71*a* of the hydraulic pressure chamber 70 is reduced and condensation "W" in the area 71*a* is pressurized.

Pressure in the area 71*a* increases and the check valve 74 is closed. Condensation "W" in the area 71*a* flows into the siphon 20 via the inlet 73*b* of the base 72 so as to fill the siphon 20.

Siphon operation starts. Once the pressure in the siphon 20 becomes lower than that of the water tank 10, the check valve 74 is opened, in which the check valve 74 had closed the water channel 73 of the base 72. The condensation "W" keeps discharging from the water tank 10 with no power and no noise.

Figure 10D:
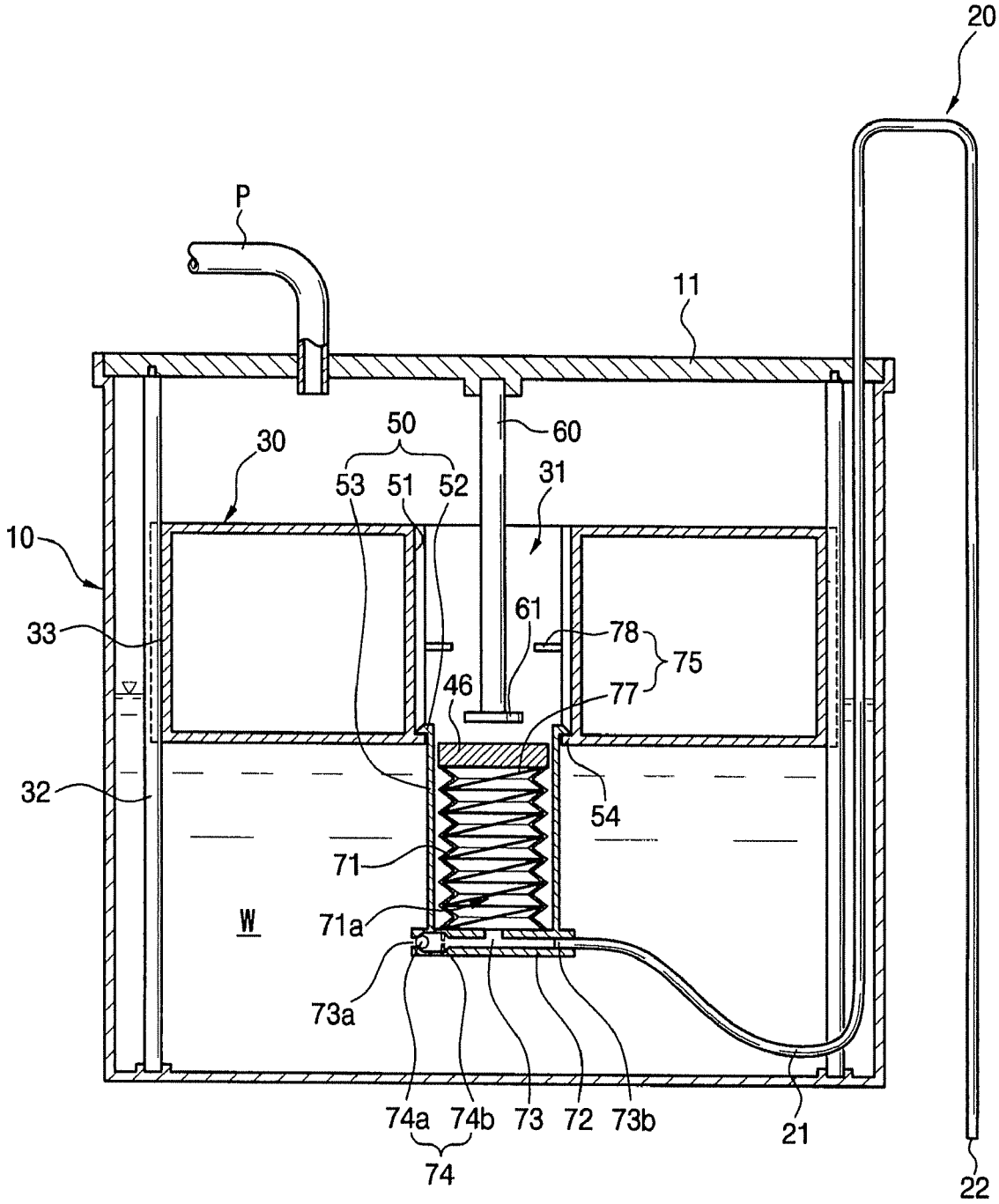

By the siphon operation, condensation "W" in the water tank 10 has been exhausted. The water level of the water tank 10 is gradually lowering. As shown in FIG. 10*d*, the float 30 descends along with the lowing water level. The container 71 that is compressed by the push rod 60 expands to the free state by an elastic force of the coil spring 77 provided in the container 71.

Furthermore, the hydraulic pressure chamber 70 reaches the bottom of the water tank 10 along with the lowing water level. The float 30 moves down toward the hydraulic pressure chamber 70, and several pushers 78 provided the middle height of the hole 31 push the top rim of the container 71. Finally, the hole 31 of the float 30 fits around the hydraulic pressure chamber 70 as shown in FIG. 10*a*.

Most condensation "W" in the water tank 10 is discharged, and both the float 30 and the hydraulic pressure chamber 70 are placed on the floor of the water tank 10. The air of the water tank 10 comes in the siphon 20, and the siphon action suspends to also stop the exhaust from condensation "W". The inside of the siphon 20 is empty again.

As time goes by in the above state, condensation "W" flows in the water tank 10 and reaches a certain water level. As described above, the float 30 moves up again due to the buoyancy of the condensation "W". The siphon action resumes exhausting condensation "W". Condensation "W" can be automatically discharged.

Figure 11:
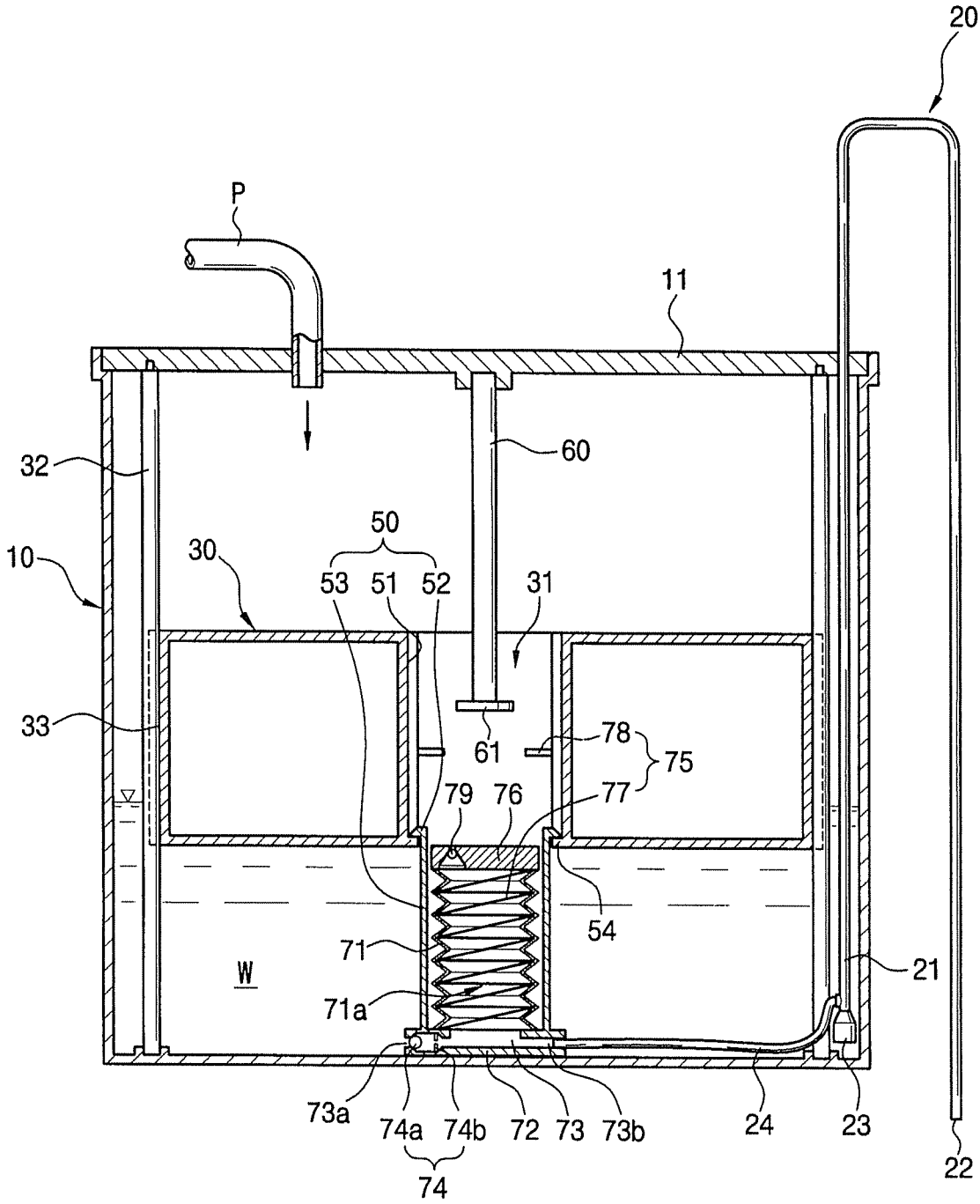
FIG. 11 is a sectional view of an automatic drain apparatus of condensation according to the modified embodiment of second embodiment of the present invention.

FIG. 11 shows a modification of second embodiment of an automatic draining apparatus according to the present invention. The second check valve 79 is further added to the components of the first embodiment. The second check valve 79 is disposed at the top of the head 76 of the container 71 and allows an air to flow into, but not allows the water to discharge from the container 71.

In the modified embodiment, as condensation "W" of the tank 10 flows into the container 71, the air in the container 71 comes out through the second check valve 79. As no air layer does exist at the top of the container 71, much condensation "W" is filled. Thus, the container having less volume can be attained.

In the construction of the second and modified embodiments, there is no problem in the function of the present invention even if the coil spring is removed.

If the container 71 has enough flexibility and little lighter specific gravity than that of water, when no condensation "W" in the tank 10, the container 71 collapsed by the pusher 78 of the float 30 can be expanded by the buoyancy. In other words, the condensation "W" comes in and the float 30 rises up to release constrain of the collapsed container 71. As a result, even if the container 70 has no coil spring 77 for compressing the container 71, the hydraulic pressure chamber 70 can exhibit proper function.

It is desirable that the coil spring 77 can be employed to assure the fast and stable expansion/compression of the container 71.

Figure 12:
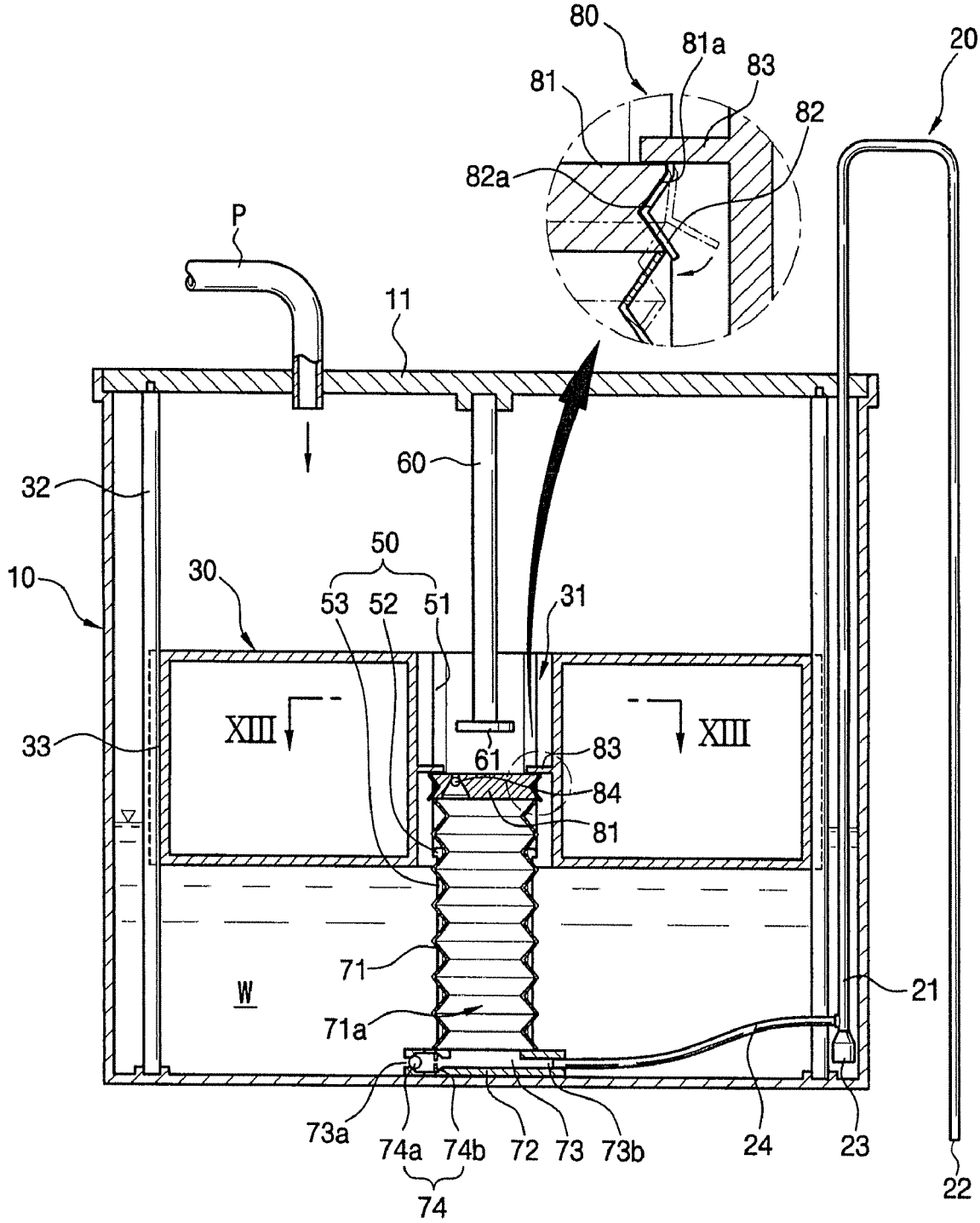
FIG. 12 is a sectional view of an automatic drain apparatus of condensation according to third embodiment of the present invention.
Figure 13:
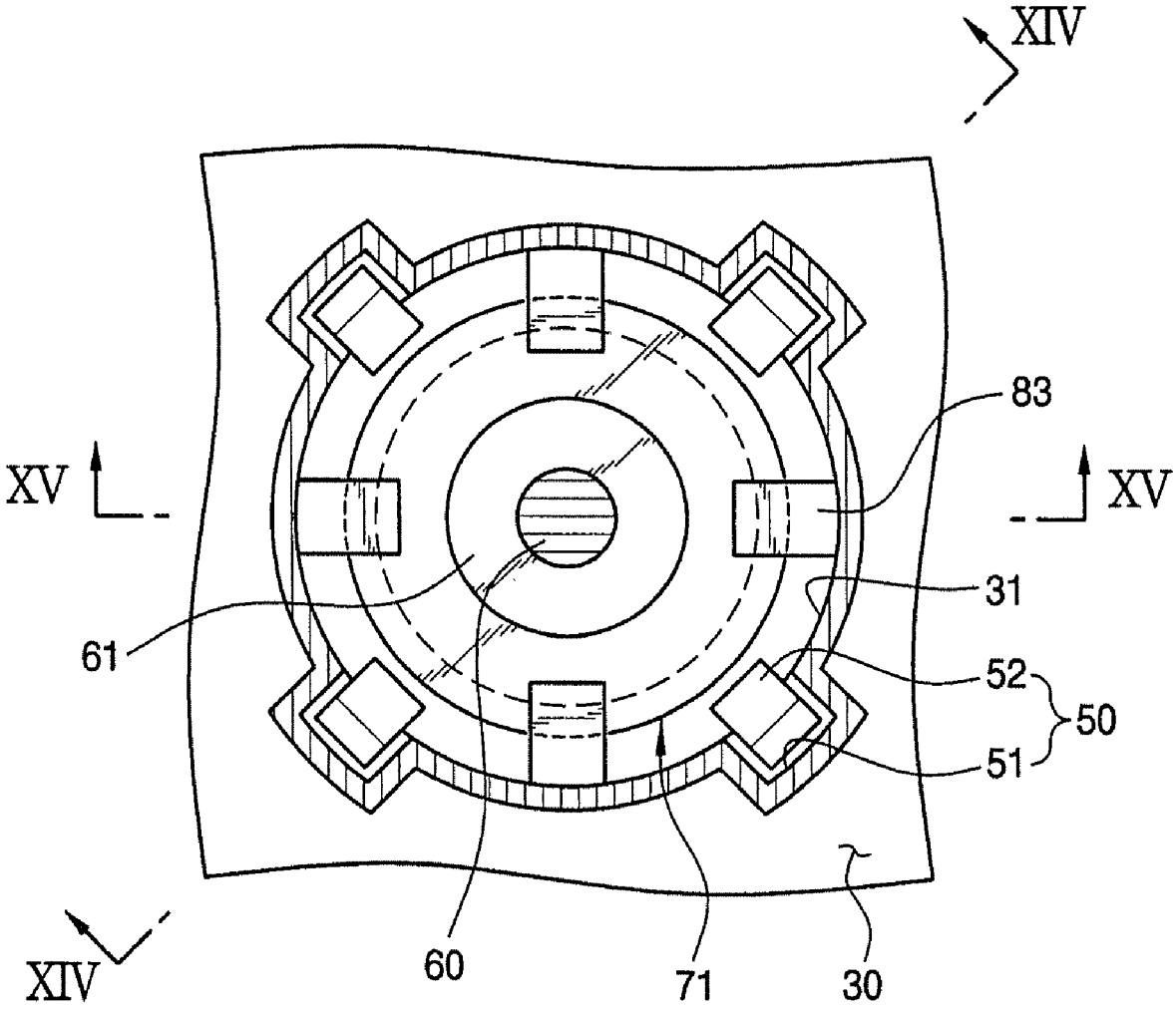
FIG. 13 is a sectional view along line XIII-XIII of FIG. 12.
Figure 14:
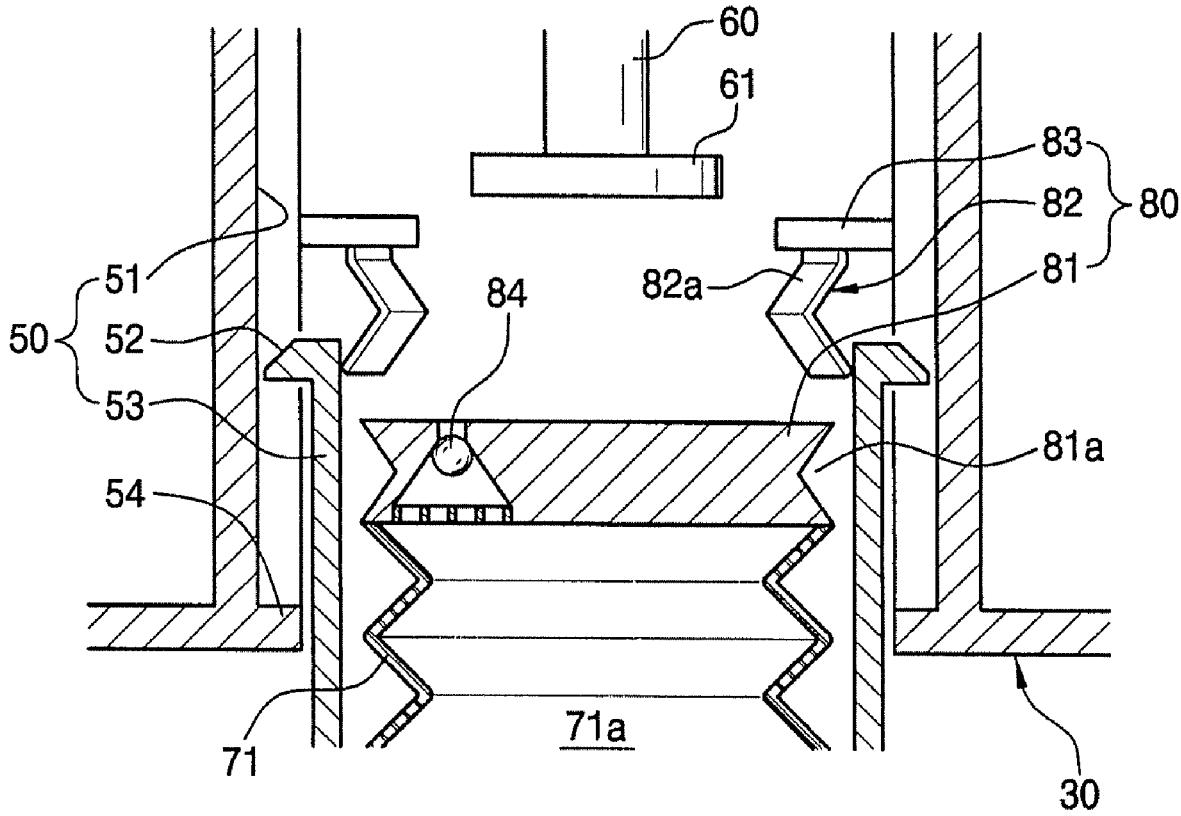
FIG. 14 is a sectional view along line XIV-XIV of FIG. 13.

FIGS. 12 to 14 show a third embodiment of an automatic draining apparatus according to the present invention. Most elements of the third embodiment are same as those of the second embodiment except some elements. Therefore, the detailed description will be omitted, denoting the same reference numerals of the same components described in the second embodiment.

In addition to the components of the second embodiment, a resilient member 80 of a head 81 having a groove 81*a*, that is placed on the top of the container 71, and the plural spring holders 82 that are protruded from the middle of the wall of the hole 31 of the float 30 in a predetermined angle interval, and that are fitted/released into/from the groove 81*a* of the head 81 along the up/down movement of the float 30.

The plural grooves 81*a* can be arranged at a predetermined angle interval to correspond each spring holder 82, or, can be provided along the whole circumference of the head 81.

The spring holder 82 can be configured in many forms. As shown in FIG. 13, the spring holder has "V" shape, and the upper end of the spring holder 82 is fixed to the inner wall of the hole 31 of the float 30 via the connecting strip 83. The bend portion 82*a* is elastically fitted into or released from the groove 81*a* of the head 81 according to the up/down movement of the container 71. To ensure the operation of the spring holder 82, the spring holder 82 has smaller elasticity than the buoyancy of the condensation "W" and the deadweight of the float 30.

It is preferred that the spring holders 82 are placed between the groove 51 (the supports 53) so as not to intervene the operation of the tower 50.

As similar to the modified embodiment of the second embodiment (FIG. 11), the head 81 of the container 71 has further the second check valve 84 to allow the air come in, but not allow the condensation come out. Thus, the condensation "W" is fully filled into the area 71*a* of the container 71.

The operation of the third embodiment of the automatic draining apparatus for condensation will be described herein below with reference to FIGS. 15*a* to 15*d*.

Figure 15A:
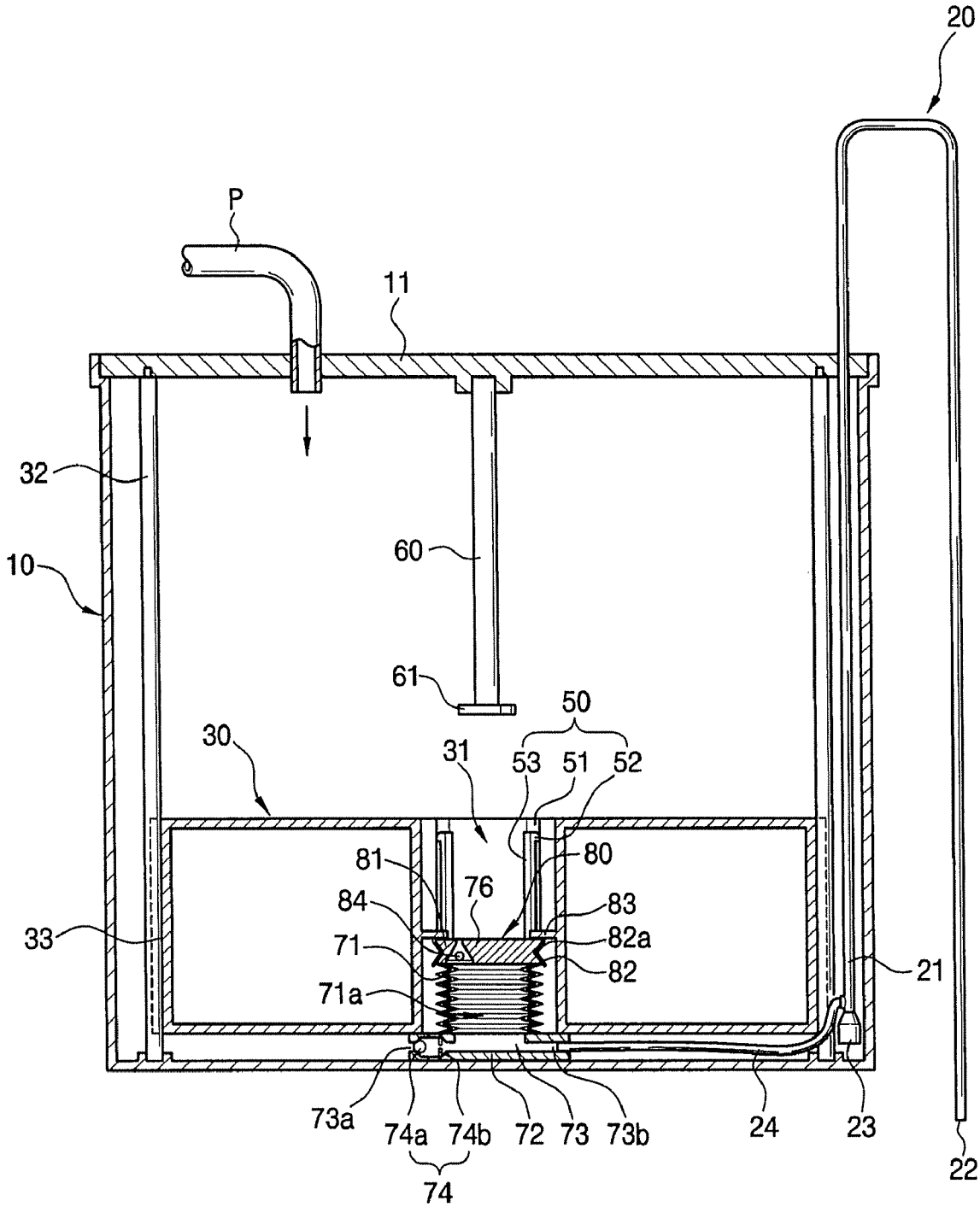
FIGS. 15*a* to 15*d* are sectional views along line XV-XV of FIG. 13 showing operation of an automatic drain apparatus of condensation according to third embodiment of the present invention.
Figure 15B:
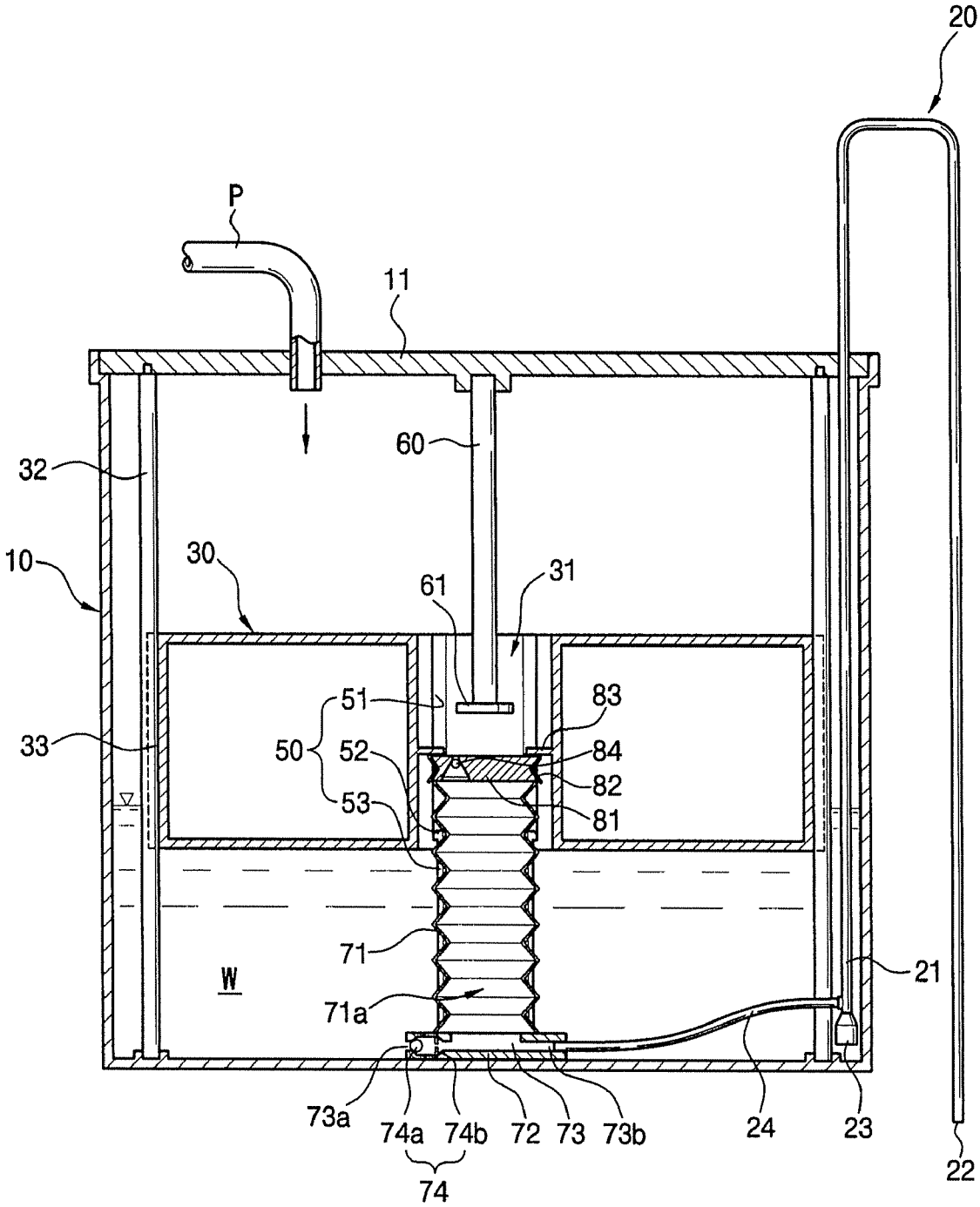

Firstly, as shown FIG. 15*a*, when the air conditioner does not operate, there is no or little condensation in the water tank 10. Thus, the inside of the water tank 10 is almost empty. The spring holders 82 installed at the hole 31 of the float 30 is elastically fitted into the groove 81*a* of the head 81 of the container 71. The container 71 of the hydraulic pressure chamber 70 is pressurized by the deadweight of the float 30. The pressed container 71 puts into the hole 31 of the float 30. The float 10 assembled with the container 71 sits on the floor of the water tank 10. The siphon 20 is also empty.

In the empty state, as the air conditioner is working, condensation "W" formed on the air conditioner flows continuously into the water tank 10. As shown FIG. 15*b*, condensation "W" fills in the water tank 10 above a predetermined water level. As buoyancy is going to be greater than the deadweight of the float 30, the float 30 moves up along the guider 32 by the buoyancy of the float 30.

However, since the hydraulic pressure chamber 70 has a greater specific gravity than that of the condensation "W", the hydraulic pressure chamber 70 does not move up and still stays on a floor of the water tank 10. As the float 30 moves up, the clamping of the spring holder 82 onto the header 81 of the container 71 can be released.

Part of the condensation "W" in the water tank 10 opens the check valve 74 that is provided at the water channel 73 of the base 72 and flows into the container 71. At the same time, the third check valve 23 that is provided at the inlet 21 of the siphon 20 is opened against the flow direction of condensation. The condensation "W" fills in the inlet 21 of the siphon 20 at the same water level of the water tank 10.

If no second check valve 84 is provided at the head 81 of the container 71, there is the pressurized air of the container 71 at the upper space of the area 71*a*. On the other hand, if the second check valve 84 is provided at the head 81, all air of the area 71*a* is exhausted. The condensation "W" is filled in the area 71*a*.

As the level of condensation "W" in the water tank 10 is going to rise, the bottom of the float 30 reaches the top edge of the hydraulic pressure chamber 70. The rim 54 provided at the lower end of the guide groove 51 contacts the protrusion 52 provided at the upper end of the supporter 53. The hydraulic pressure chamber 70 is locked to the float 30 that continues to move up due to the condensation "W" continuously flowing into the water tank 10, and the hydraulic pressure chamber 40 also moves up.

Figure 15C:
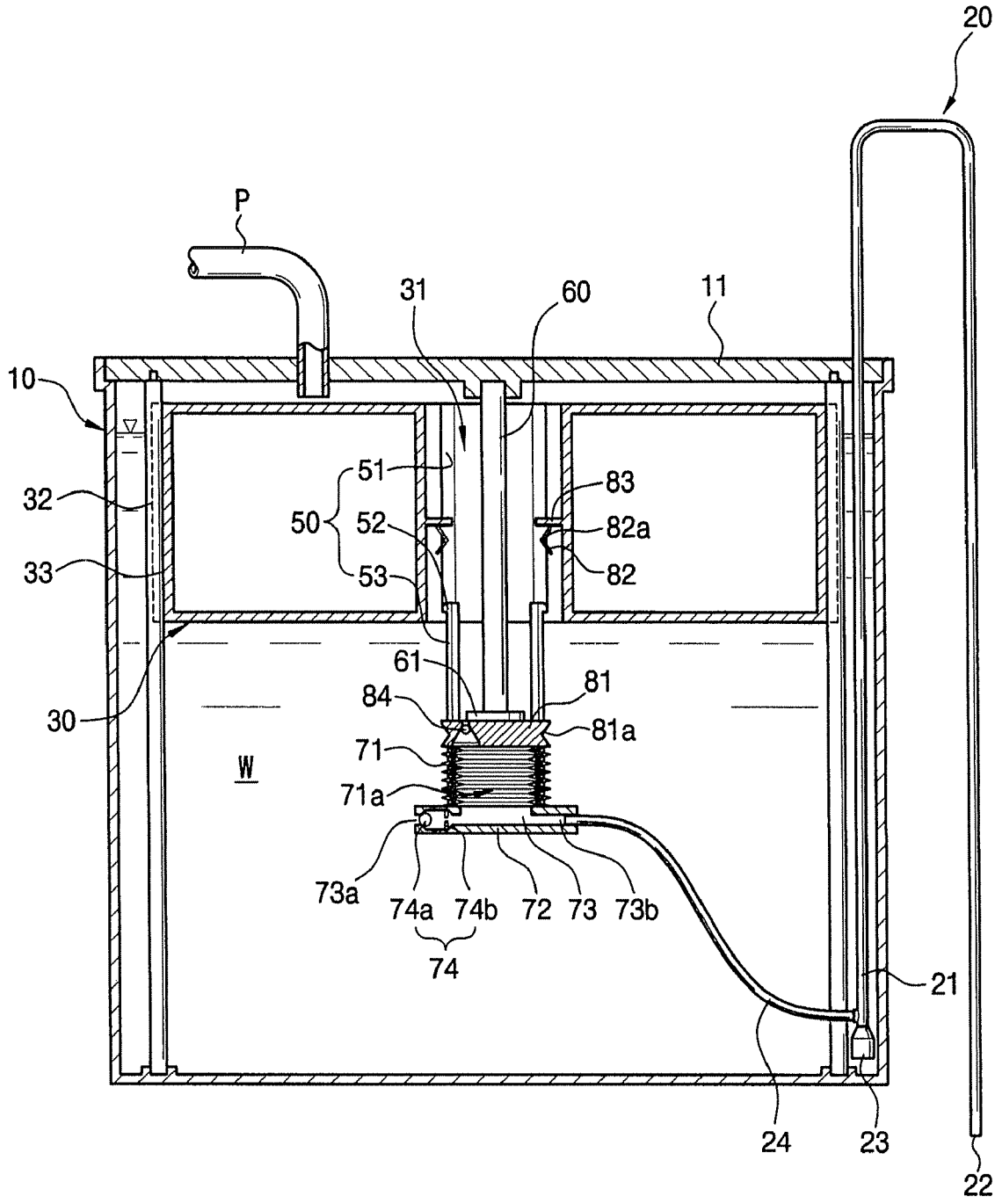

Furthermore, as the float 30 moves further up, as shown in FIG. 15*c*, the head 76 of the container 71 is contacted by the push rod 60 extended down from the center of the cover 11. Thus, the push rod 60 resists the upward movement of the hydraulic pressure chamber 70. The spring holder 82 installed at the inner wall of the hole 31 of the float 30 is released from the groove 81*a* of the head 81 by the buoyancy.

However, the base 72 has received a pull-up force by the rising float 30 since the protrusion 52 of the supporter 53 is placed on the rim 54 of the float 30. The hydraulic pressure chamber 70 is gradually pressed by the up-movement of the float 30. The volume of the area 71*a* of the hydraulic pressure chamber 70 is reduced and condensation "W" in the area 71*a* is pressurized.

Pressure in the area 71*a* is increased. The check valve 74 and the third check valve 23, or the check valve 74 and the second and third check valve 84,23 are closed. Condensation "W" in the area 71*a* flows into the siphon 20 via the inlet 73*b* at the base 72 so as to fill the siphon 20.

Siphon operation starts. The check valve 74 is opened, in which the check valve 74 had closed the water channel 73 of the base 72. The condensation "W" keeps discharging from the water tank 10 with no power and no noise.

Figure 15D:
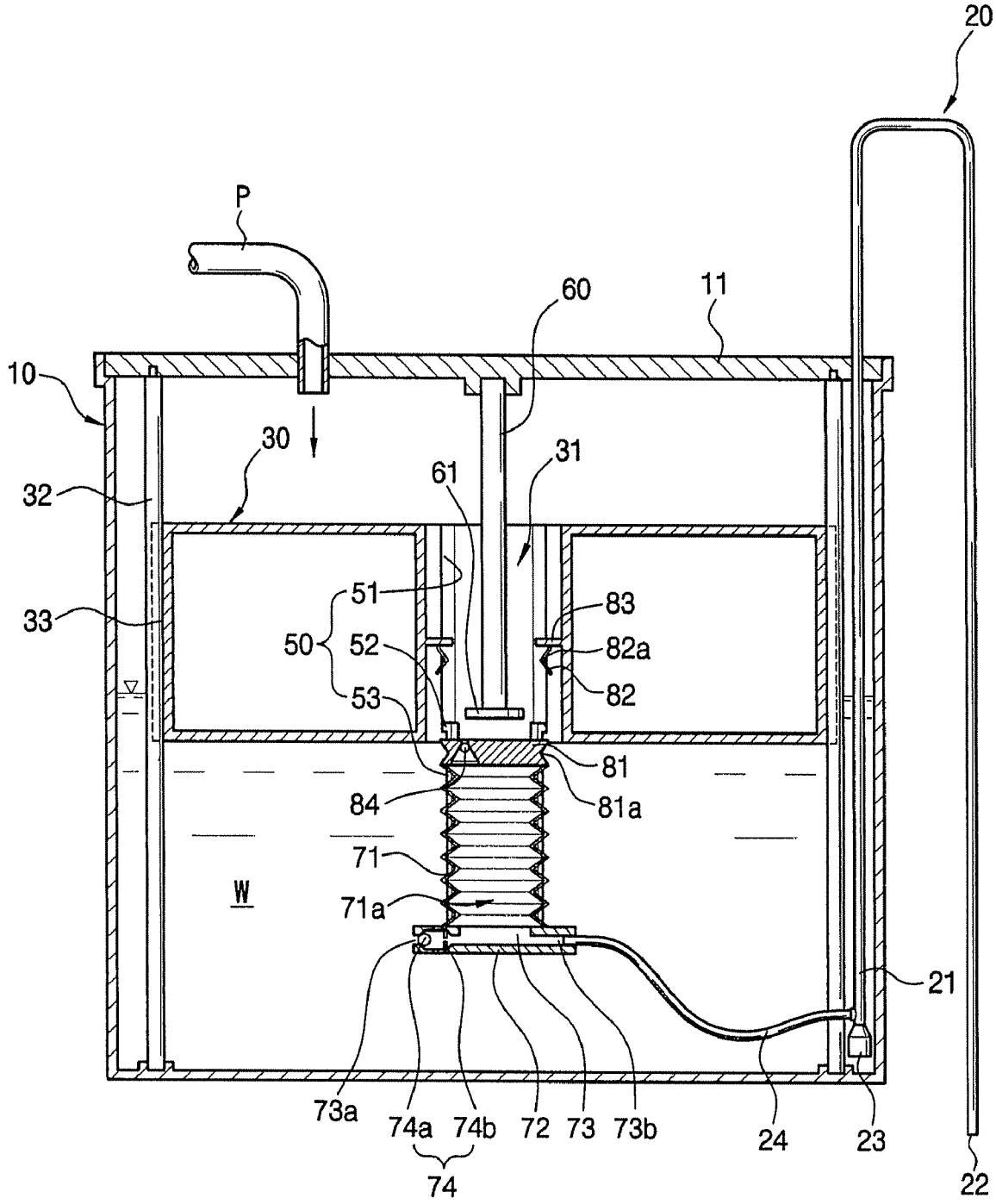

By the siphon operation, condensation "W" in the water tank 10 has been exhausted. The water level of the water tank 10 is gradually lowering. As shown in FIG. 15*d*, the float 30 and the hydraulic pressure chamber 70 descend along with the lowing water level.

Furthermore, the hydraulic pressure chamber 70 reaches the bottom of the water tank 10 along with the lowing water level. The float 30 moves down toward the hydraulic pressure chamber 70, and several spring holders 82 provided the middle height of the hole 31 push the top rim of the container 71 with a slight force. As the hydraulic pressure chamber 70 is fully compressed, the hole 31 of the float 30 fits around the hydraulic pressure chamber 70 as shown in FIG. 15*a*. The spring holders 82 are fitted into the groove 81*a* of the head 81.

Most condensation "W" in the water tank 10 is discharged, and both the float 30 and the hydraulic pressure chamber 70 are placed on the floor of the water tank 10. The air of the water tank 10 comes in the siphon 20, and the siphon action suspends to also stop the exhaust from condensation "W". As time goes by in the above state, condensation "W" flows in the water tank 10 and reaches to a certain water level. As described above, the float 30 moves up again due to the buoyancy of the condensation "W". The siphon action resumes exhausting condensation "W". Condensation "W" can be automatically discharged.

Figure 16:
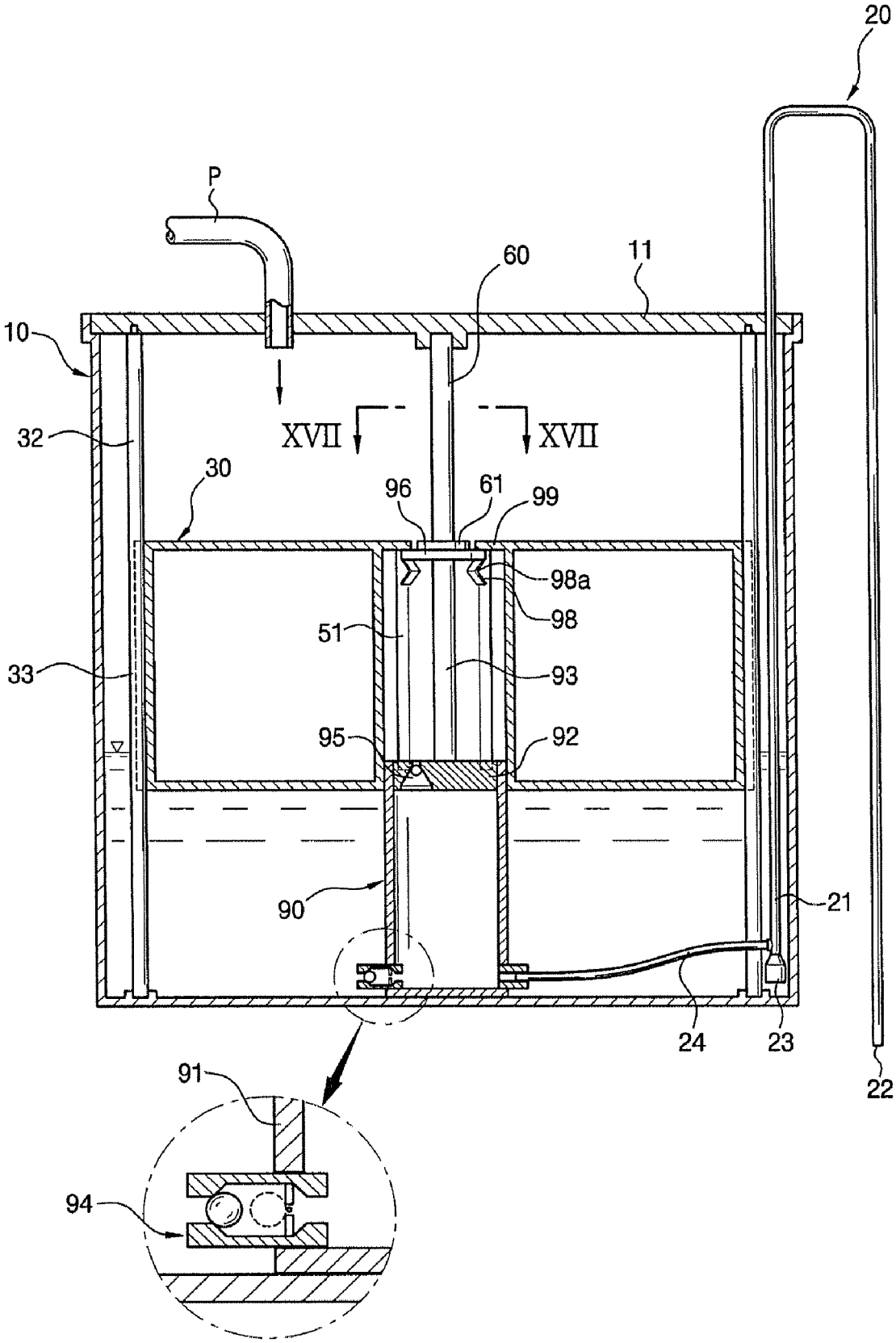
FIG. 16 is a sectional view of an automatic drain apparatus of condensation according to fourth embodiment of the present invention.
Figure 17:
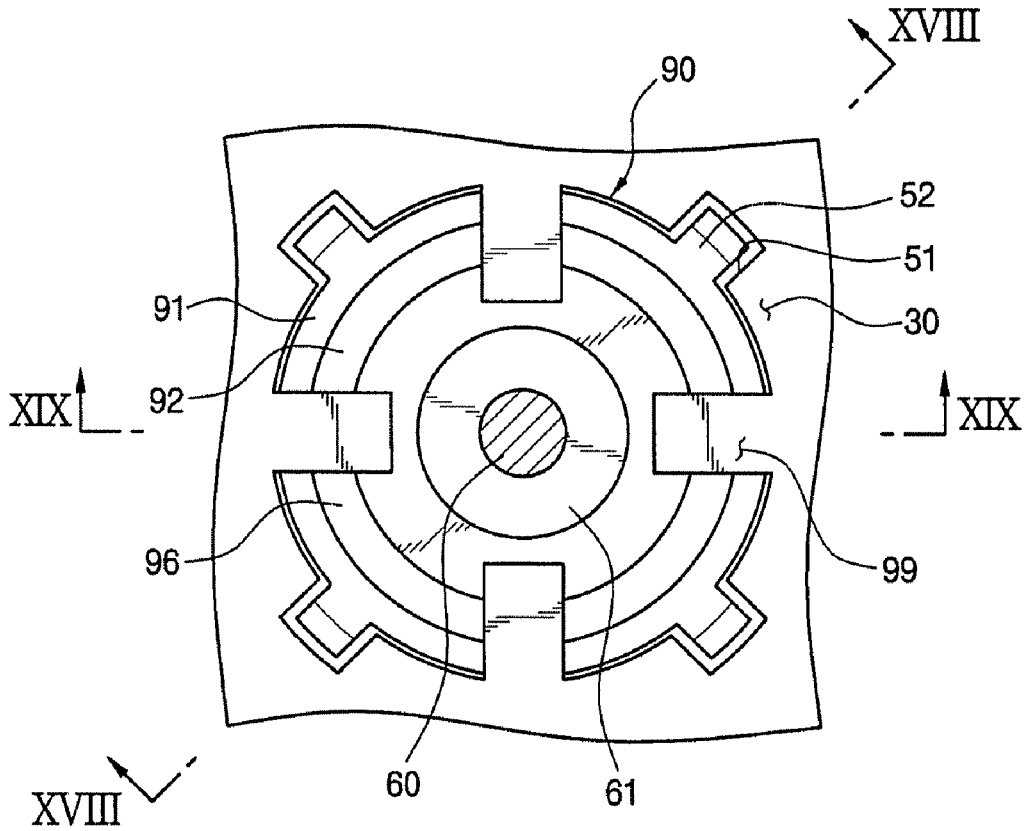
FIG. 17 is a sectional view along line XVI-XVI of FIG. 16.
Figure 18:
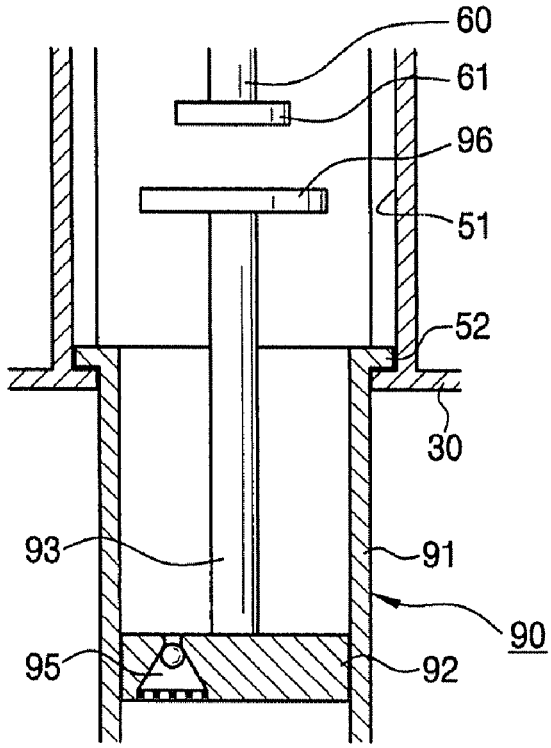
FIG. 18 is a sectional view along line XVII-XVII of FIG. 17.

FIGS. 16 to 18 show a fourth embodiment of an automatic draining apparatus according to the present invention.

In addition to the components of the first embodiment, the hydraulic pressure chamber 90 is comprised of a cylinder 91 interconnecting to the inlet 21 of the siphon 20 via the additional pipe 24, a piston 92 provided in the cylinder to move up/down, a piston rod 93 that is attached to the piston 92, extended upward, and having a flange 96 at the end, and plural spring holders 93 that are protruded from the top of the wall of the hole 31 of the float 30 in a predetermined angle interval, and that elastically clamp/released the flange 96 of the piston rod 93 along the up/down movement of the float 30.

A first check valve 94 is provided at the bottom edge of the cylinder 91, which allows the condensation "W" only to come in the cylinder 91. A second check valve 95 is provided at the piston 92, which allows the air to flow into, but not allows the condensation "W" to discharge from the cylinder 91.

As shown FIG. 17, the protrusions 52 of the tower 50 are provided at the top circumference of the cylinder 91 at an angular interval. Each protrusion slides into the guide groove 51 of the hole 31 of the float 30.

The spring holders 98 are comprised of four pieces, for example. The upper end of the spring holder 98 is fixed to the inner wall of the hole 31 of the float 30 via the connecting strip 99. It is preferred that the spring holders 98 are placed between the groove 51 (the protrusion 52) so as not to intervene the operation of the cylinder 91.

The spring holder 98 can be configured in many forms. As similar to the third embodiment, the spring holder has "V" shape, and the bend portion 98*a* elastically clamps or releases the flange 96 of the piston rod 93.

The operation of the fourth embodiment of the automatic draining apparatus for condensation will be described herein below with reference to FIGS. 19*a* to 19*d*.

Figure 19A:
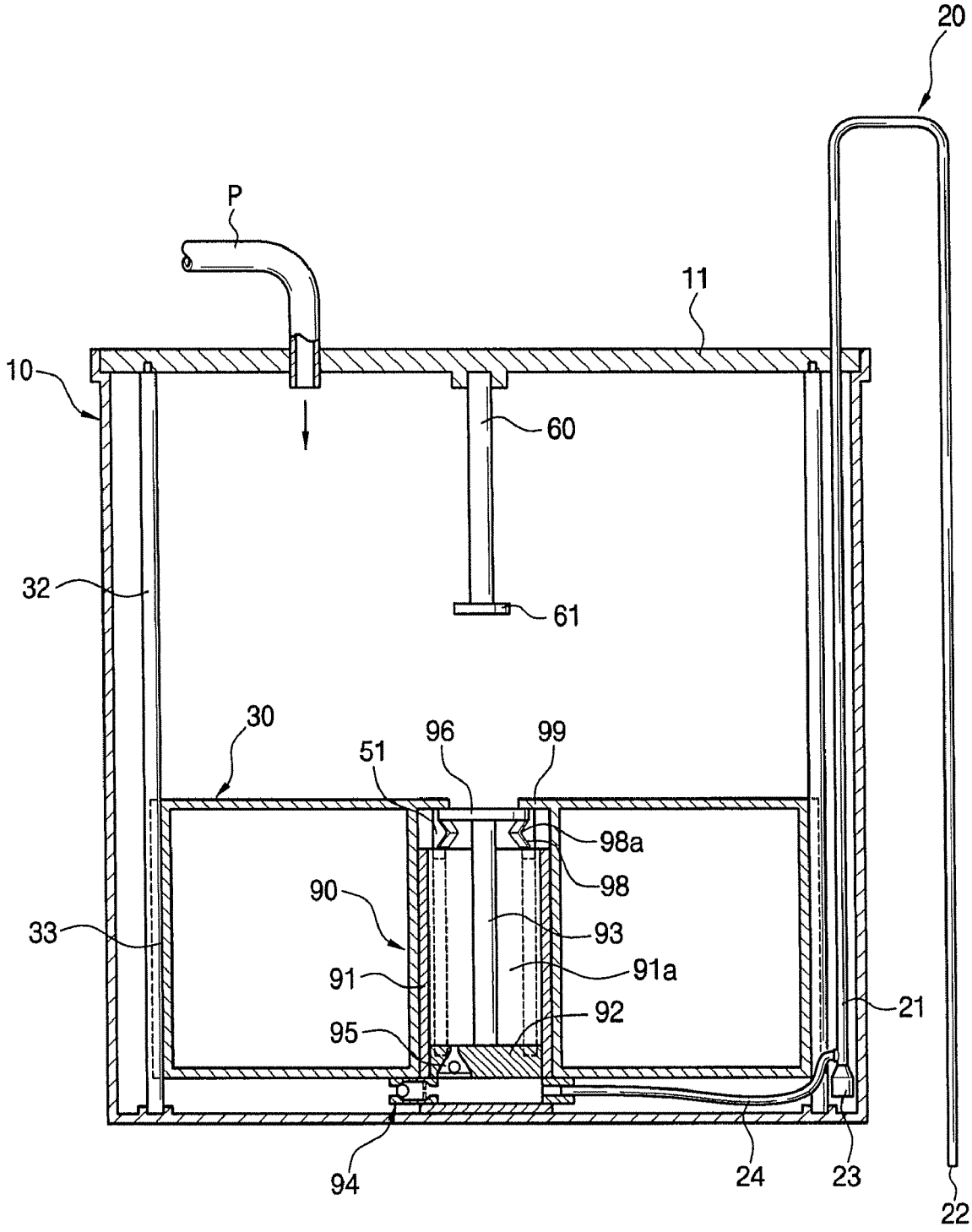
FIGS. 19*a* to 19*d* are sectional views along line XVII-XVII of FIG. 17 showing operation of an automatic drain apparatus of condensation according to fourth embodiment of the present invention.
Figure 19B:
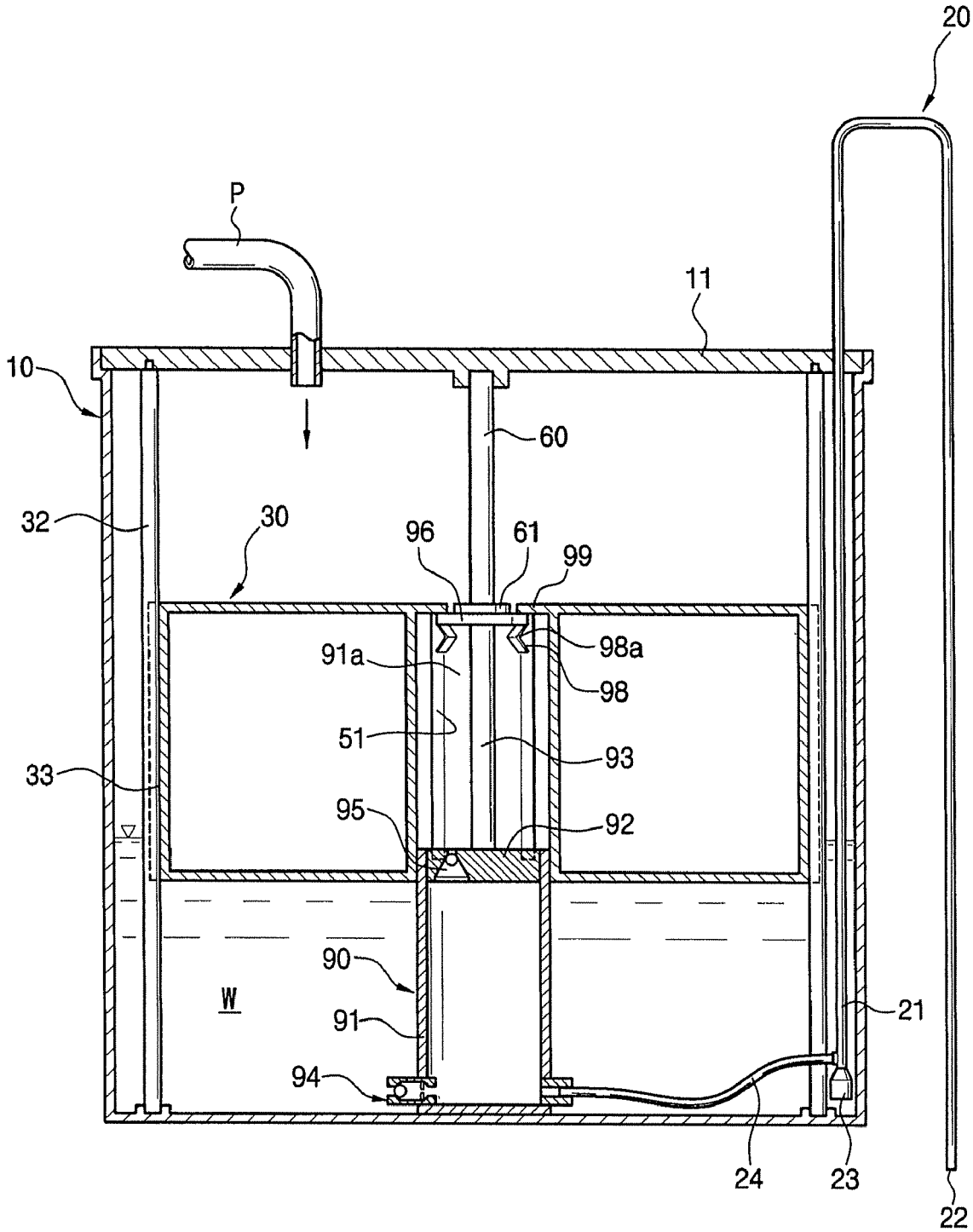

Firstly, as shown FIG. 19*a*, when the air conditioner does not operate, there is no or little condensation in the water tank 10. Thus, the inside of the water tank 10 is almost empty. The piston 92 sits on the floor of the water tank 10. The cylinder 91 having the piston 92 is assembled into the hole 31 of the float 30. The spring holders 98 installed at the inner wall of the hole 31 of the float 30 clamp elastically the circumference of the flange 96 of the piston rod 93.

In the empty state, as the air conditioner is working, condensation "W" formed on the air conditioner flows continuously into the water tank 10. As shown FIG. 19*b*, condensation "W" fills in the water tank 10 above a predetermined water level. As buoyancy is going to be greater than the deadweight of the float 30, the float 30 moves up along the guider 32 by the buoyancy of the float 30.

However, since the hydraulic pressure chamber 90 has a greater specific gravity than that of the water, the hydraulic pressure chamber 90 does not move up and still stays on a floor of the water tank 10. As the spring holder 98 of the float 30 clamps the flange 96 of the piston rod 93, the piston 92 moves up to the top of the cylinder 91 along with the move-up of the float 30. At the same time, the condensation "W" flows into the water tank 10 from the air conditioner, and part of the condensation "W" opens both the first check valve 94 provided at the lower edge of the cylinder 91 and the third check valve 23 provided at the inlet 21 of the siphon 20. The condensation "W" fills in both the lower area 91*a* of the cylinder 91 and the inlet 21 of siphon 20 at the same water level of the water tank 10.

The air in the area 91*a* comes out through the second check valve 95. The cylinder 91 is fully filled with the condensation.

As the level of condensation "W" in the water tank 10 is going to rise, the bottom of the float 30 reaches the top edge of the cylinder 91. The rim 54 provided at the lower end of the guide groove 51 contacts with the protrusion 52 provided at the upper edge of the cylinder 91. The hydraulic pressure chamber 90 is locked to the float 30 that continues to move-up due to the condensation "W" continuously flowing into the water tank 40, and the hydraulic pressure chamber 90 also moves up.

Figure 19C:
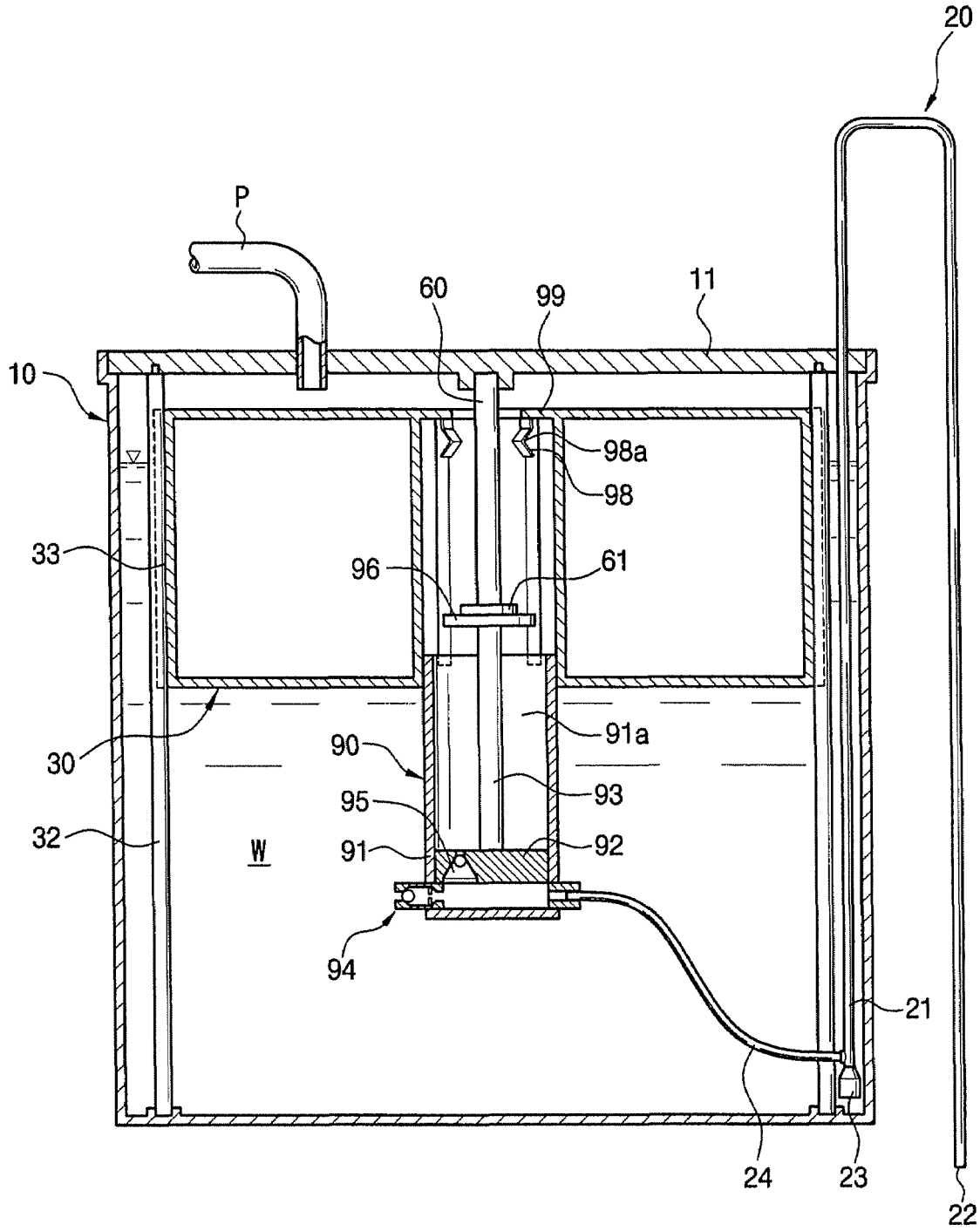

As the float 30 moves further up, as shown in FIG. 19*c*, the flange 96 provided at the top of the piston rod 93 contacts the push rod 60 extended down from the center of the cover 11. The upward movement of the hydraulic pressure chamber 40 is resisted. Thus, the spring holder 98 provided at the hole 31 is released from the flange 96 of the piston rod 93.

However, since the protrusion 52 is locked by the rim 54, the cylinder 91 continues moving up along with the move-up of the float 30. The piston rod 93 that is in still gradually presses the area 91*a* of the cylinder 91. The volume of the area 91*a* of the cylinder 91 is reduced and the condensation "W" in the area 91*a* is pressurized.

Pressure in the area 91*a* increases. The first to third check valves 94, 95, 23 are closed. Condensation "W" in the area 91*a* flows into the siphon 20 so as to fill the siphon 20.

Siphon operation starts. The first, third check valves 94, 23 are opened. The condensation "W" keeps discharging from the water tank 10 with no power and no noise.

Figure 19D:
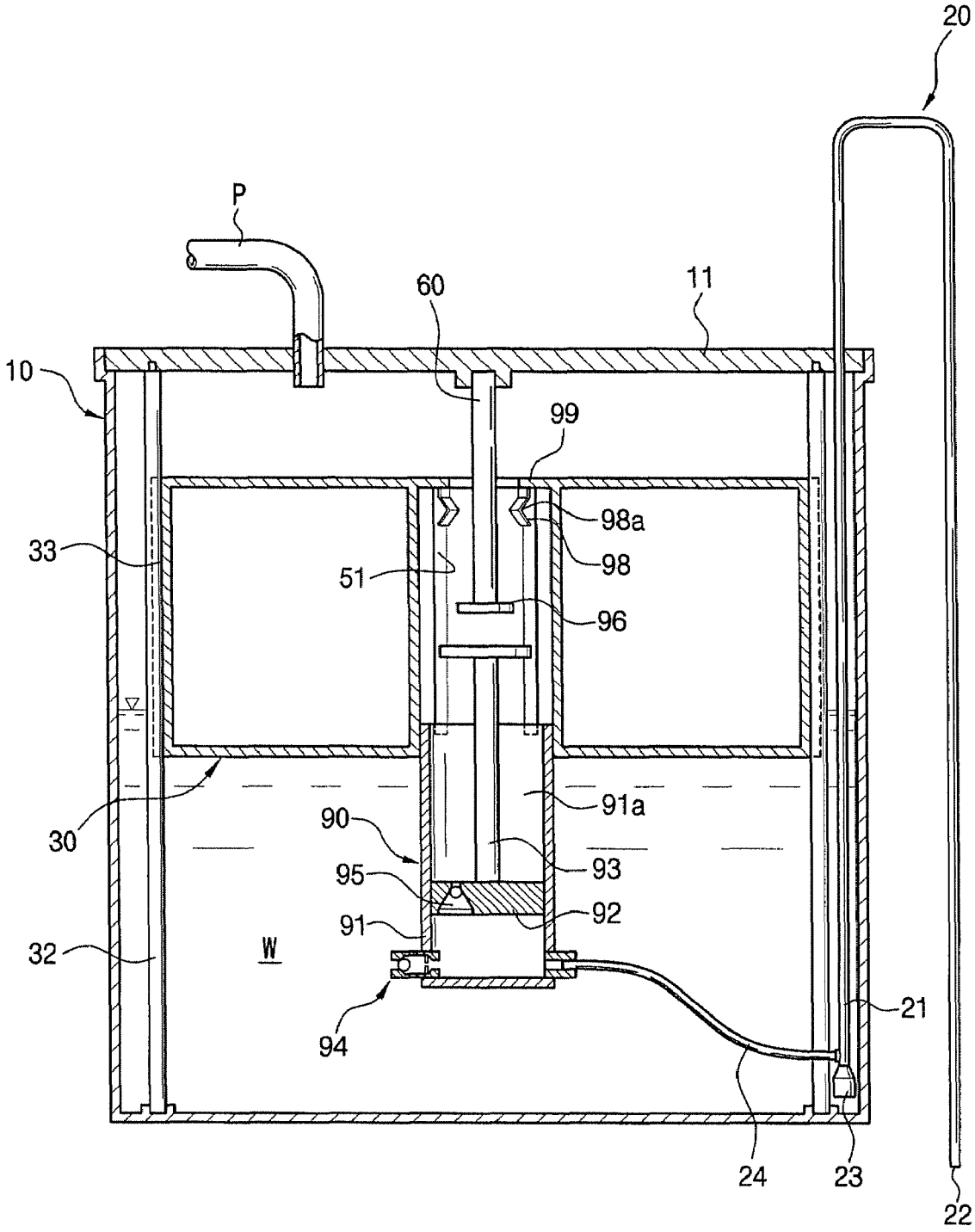

By the siphon operation, condensation "W" in the water tank 10 has been exhausted. The water level of the water tank 10 is gradually lowering. As shown in FIG. 19*d*, the float 30 and the hydraulic pressure chamber 90 descend along with the lowing water level.

Furthermore, the hydraulic pressure chamber 90 reaches the bottom of the water tank 10 along with the lowing water level. The float 30 moves down against the hydraulic pressure chamber 90, and the hole 31 of the float 30 is fitted around the cylinder 91. Several spring holders 82 provided at the hole 31 clamp elastically the piston rod 93. The moving-down piston rod 93 pushes the piston 92. This comes back to an initial state.

Most condensation "W" in the water tank 10 is discharged, and both the float 30 and the hydraulic pressure chamber 90 are placed on the floor of the water tank 10. The air of the water tank 10 comes in the siphon 20, and the siphon action suspends to also stop the exhaust from condensation "W". As time goes by in the above state, condensation "W" flows in the water tank 10 and reaches at a certain water level. As described above, the float 30 moves up again due to the buoyancy of the condensation "W". The siphon action resumes exhausting condensation "W". Condensation "W" can be automatically discharged.

Figure 20A:
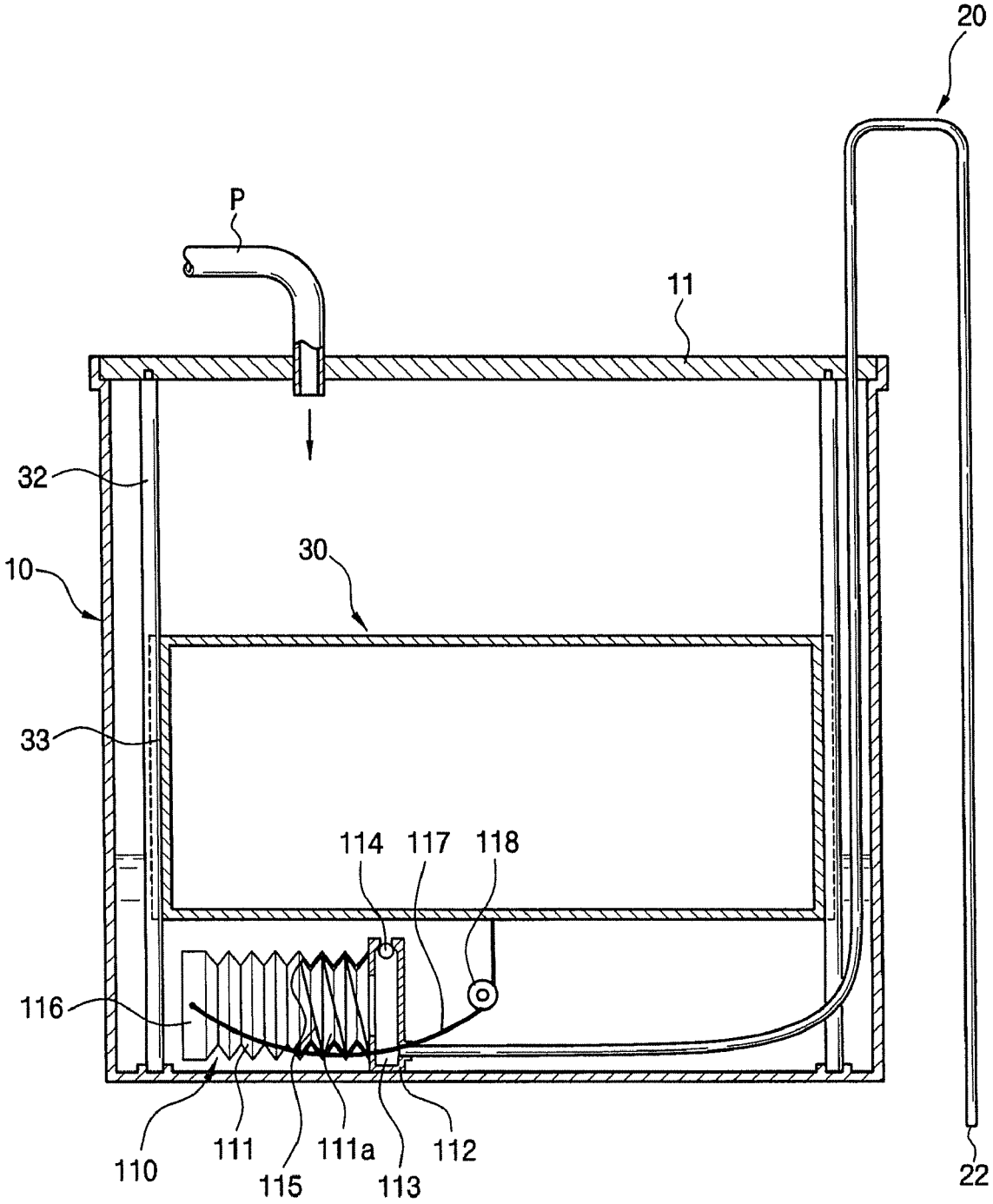
FIGS. 20*a* and 20*b* are sectional views showing expansion and compression state of a hydraulic pressure chamber of an automatic drain apparatus of condensation according to fifth embodiment of the present invention.
Figure 20B:
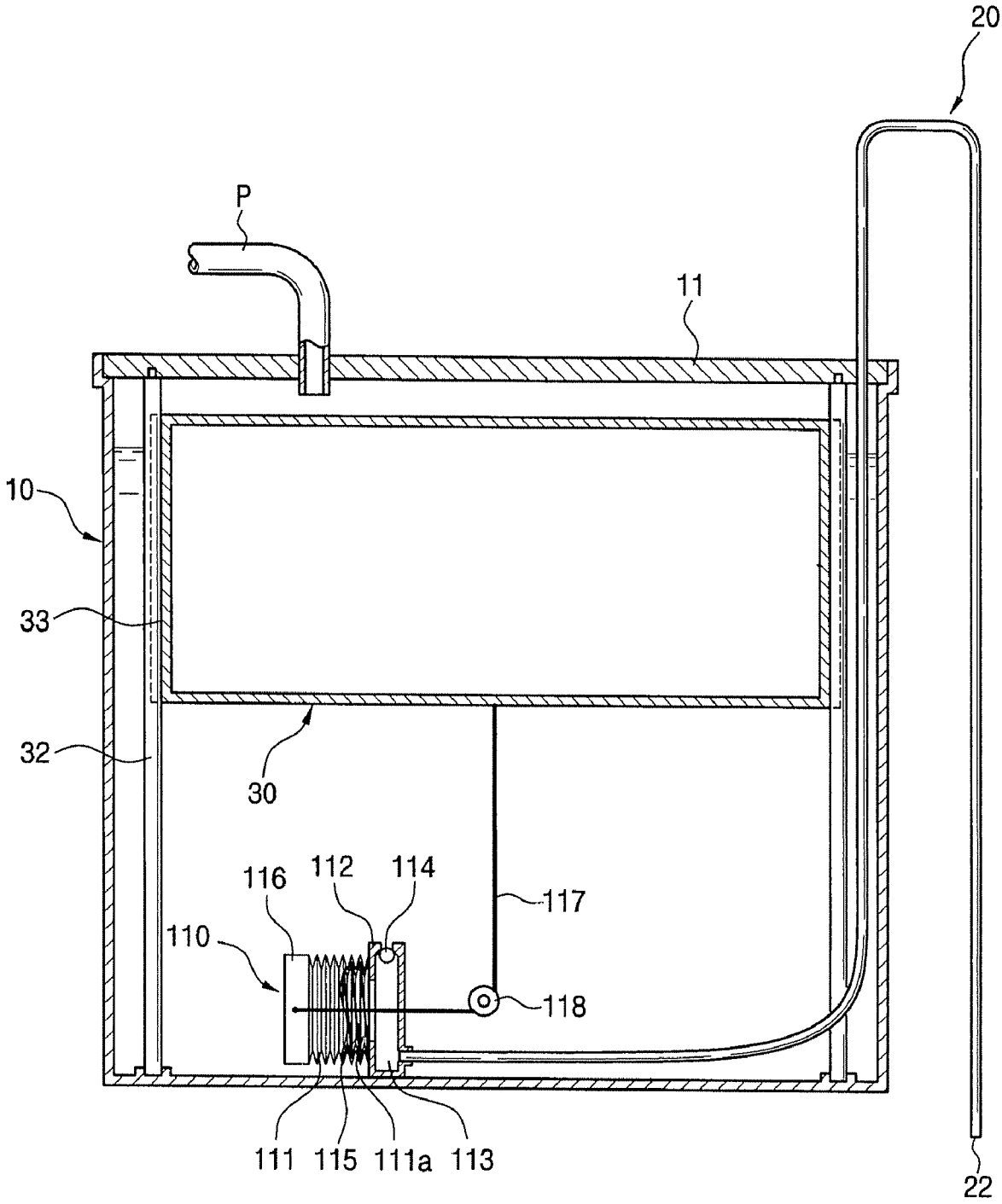

FIGS. 20*a* and 20*b* show a fifth embodiment of an automatic draining apparatus according to the present invention. In addition to the components of the first embodiment, a hydraulic pressure chamber 110 is comprised of a volume changeable container 111 having an area 111*a* for containing the condensation "W" and placed on the floor of the water tank 10 horizontally, and having a resilient force along the expansion direction. The hydraulic pressure chamber 110 is further comprised of a base 112 provided at the one end of the container 111 and fixed to the floor of the water tank 10, and a wire 117 connecting between the free end of the container 111 and the float 30 along a predetermined path and pulling the free end of the container 111 for making the container 111 pressed according to the up movement of the float 30.

The container 111 can be preferably made of flexible synthetic bellows pipe. The container 111 can be configured with a resilient force in the longitudinal direction in itself, but it is acceptable that the coil spring 115 can be integrated into the container 111 to get excellent volume change.

The base 112 has a water channel 113 interconnecting to the area 111*a*. A check valve 114 is disposed at the inlet of the water channel 113 and allows the condensation to flow into the container 111. The exit of the water channel 113 is connected to the inlet 21 of the siphon 20.

The wire 117 has a guide pulley 118 under the center of the float 30, by which the hydraulic pressure chamber 110 can be horizontally expanded or compressed along the up/down movement of the float 30. The trace of the wire is similar to the shape of "L".

As the condensation comes into the water tank 10, the float 30 moves up and the wire 117 is pulled. The container 111 is compressed and the condensation fills the siphon 20. By the siphon operation, the condensation of the water tank 10 is discharged, and the float 30 moves down and the compressed container 111 is expanded by the resilient force of the coil spring 115 to the first state.

The embodiment has the same effect as the previous embodiments. But, this embodiment has an advantage of the simple configuration.

Figure 21A:
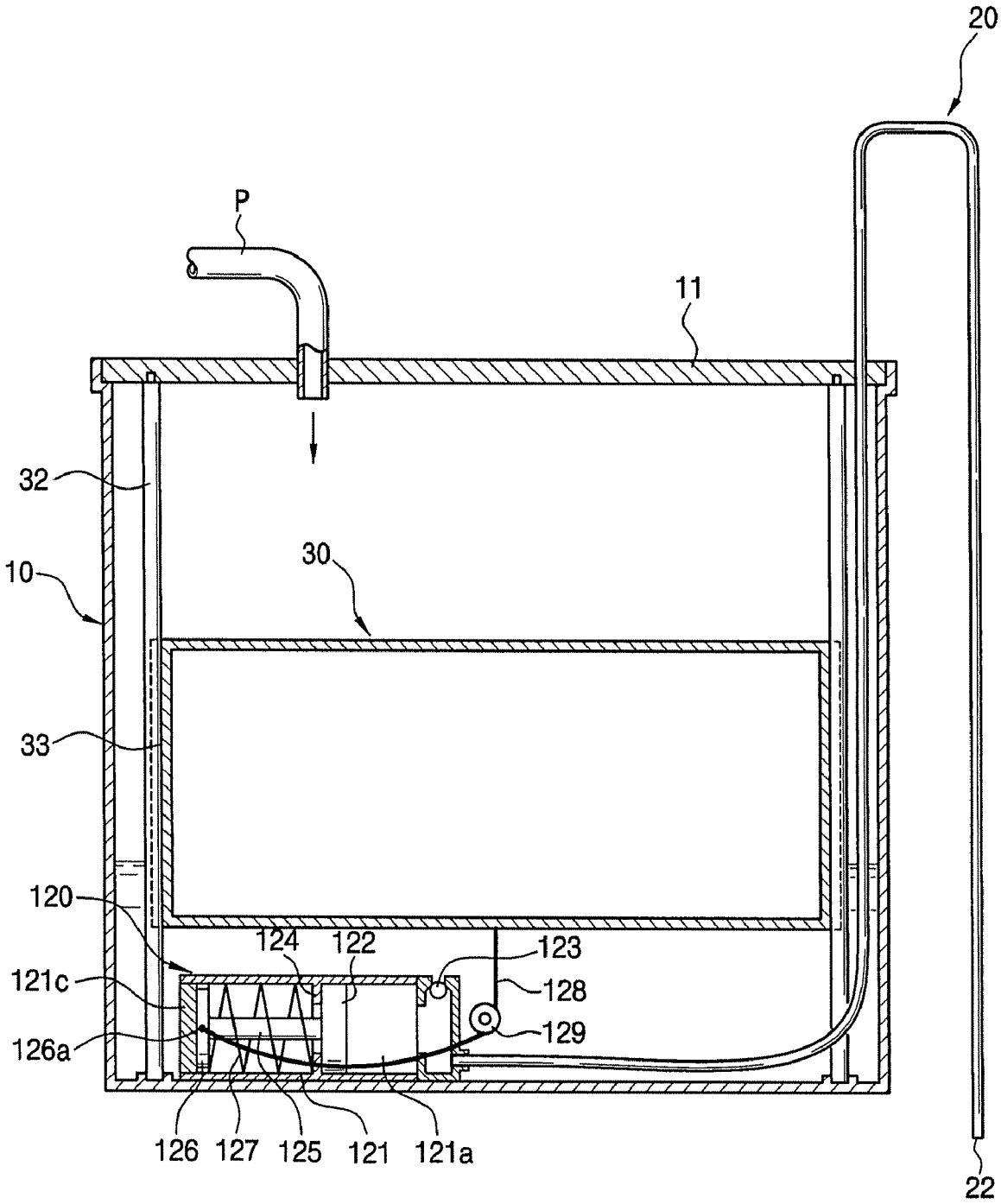
FIGS. 21*a* and 21*b* are sectional views showing expansion and compression state of an area of an automatic drain apparatus of condensation according to sixth embodiment of the present invention.
Figure 21B:
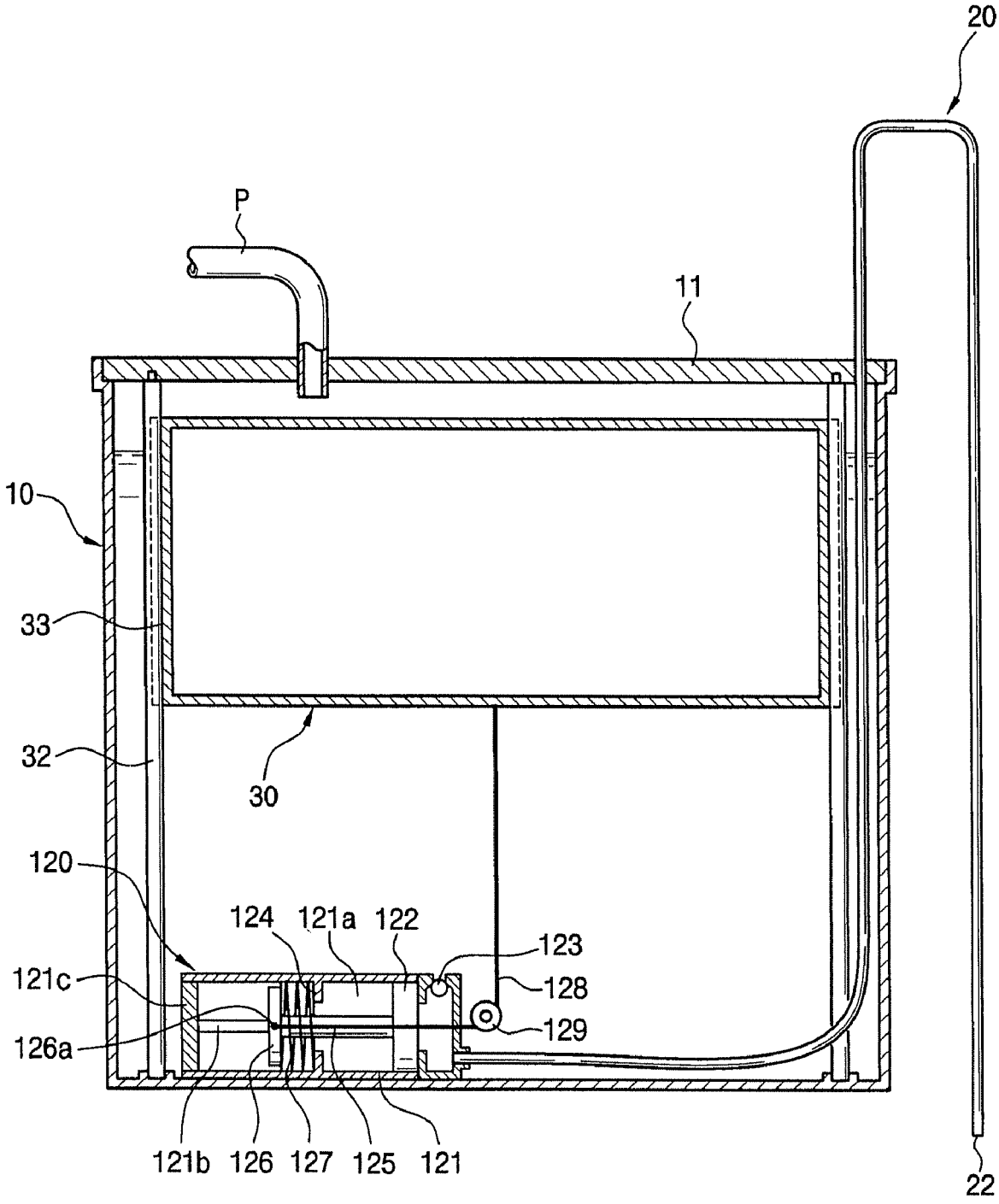

FIGS. 21*a* and 21*b* show a sixth embodiment of an automatic draining apparatus according to the present invention. In addition to the components of the first embodiment, a hydraulic pressure chamber 120 is comprised of a cylinder 121 having an area 121*a* for containing the condensation and placed on the floor of the water tank 10 horizontally. The hydraulic pressure chamber 110 is further comprised of a piston 122 that is disposed in the cylinder 121 and has a resilient force along the expansion direction of the area 121*a*, and a wire 117 connecting between the piston 122 and the float 30 along a predetermined path and making the area 121*a* pressed according to the up movement of the float 30.

A check valve 123 is disposed at the circumference of the one end of the cylinder 121 to allow the condensation come in. Each flange 124, 126 is disposed at the middle portion of the cylinder 121 and the free end of the piston rod 125, respectively. A coil spring 127 is placed between two flanges 124, 126, by which the piston 122 elastically moves toward the direction of the expansion of the area 121*a*.

It is preferred that a pair of guide slits 121*b* is longitudinally formed at one end of the cylinder 121 near the flange 126 in an opposite manner. Only one guide slit 121*b* is shown in FIG. 21*b*. Two guiding pins 126*a* are formed at the circumference of the flange 126 of the piston rod 125, and each guiding pin 126*a* moves along the guide slit 121*b*.

The wire 128 has a guide pulley 129 under the center of the float 30, by which the hydraulic pressure chamber 120 can be horizontally expanded or compressed along the up/down movement of the float 30. The trace of the wire is similar to the shape of "L".

The wire 128 can be connected directly to the piston 122, but it is preferred that the wire 128 can be connected to two guiding pins 126*a* provided at the flange 126 of the piston rod 125 as shown in Figures.

The no explained numeral 121*c* is a cover for covering the end of the cylinder 121.

As the condensation comes into the water tank 10, the float 30 moves up and the wire 128 is pulled. The piston 122 moves toward the compressing direction of the area 121*a* and the condensation fills in the siphon 20. By the siphon operation, the condensation of the water tank 10 is discharged, and the float 30 moves down and the piston 122 is moved to the initial state (the expansion direction of the area 121*a*) by the resilient force of the coil spring 127.

The embodiment has the same effect as the previous embodiments. But, this embodiment has an advantage of the simple configuration.

Figure 22:
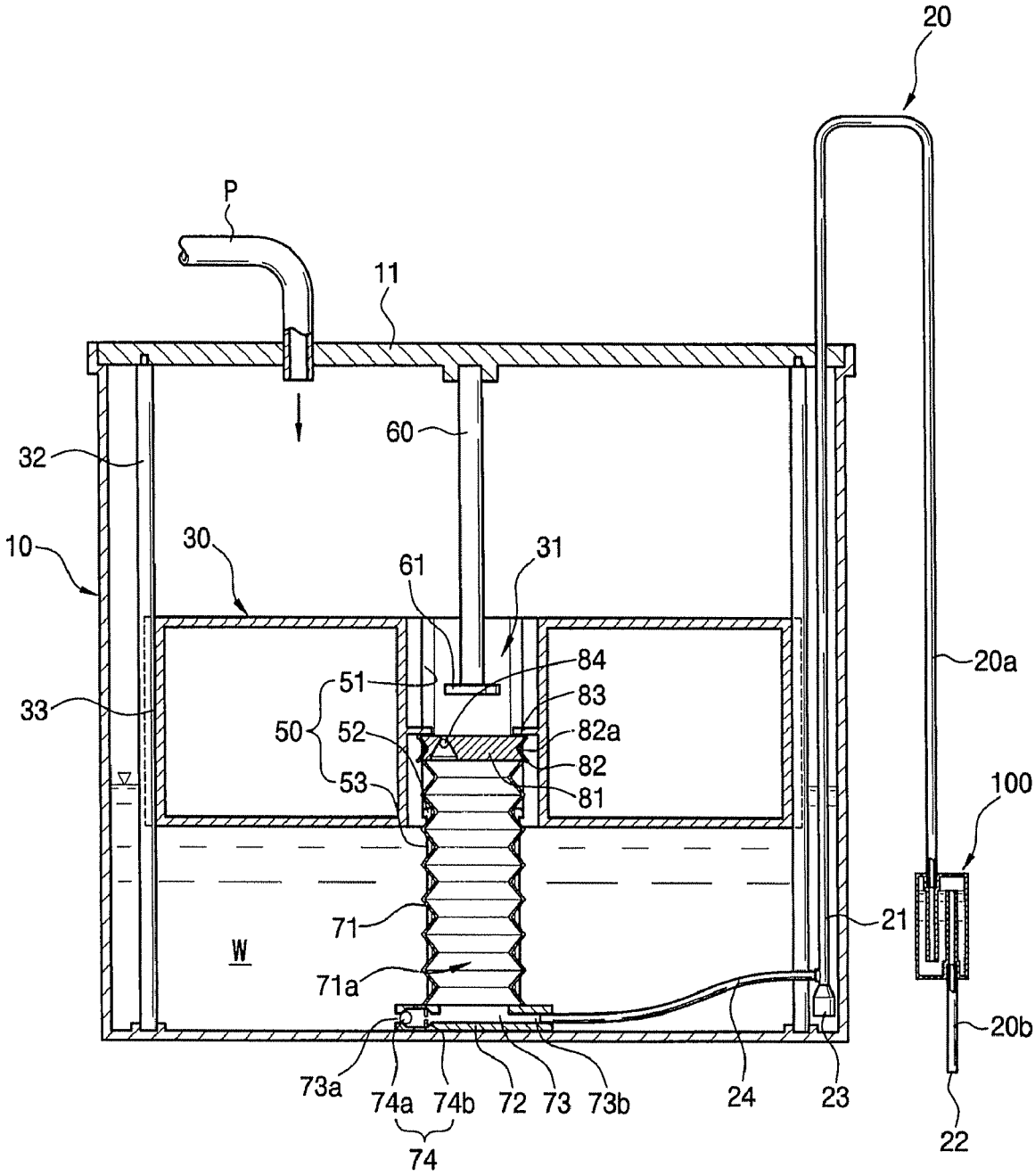
FIG. 22 is a sectional view of an automatic drain apparatus of condensation according to seventh embodiment of the present invention.
Figure 23:
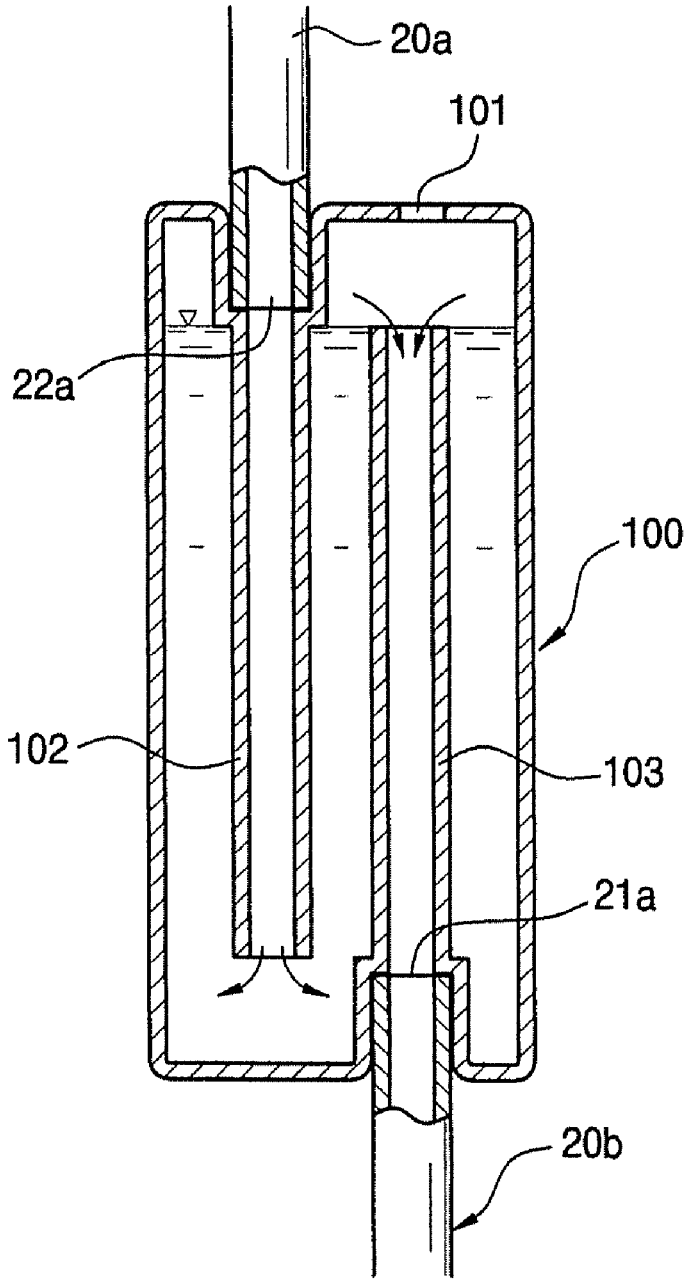
FIG. 23 is a sectional view of siphon action maintainer of FIG. 22.

FIGS. 22 and 23 show a seventh embodiment of an automatic draining apparatus according to the present invention. In addition to the components of the third embodiment, a siphon action maintainer 100 is provided for preventing the siphon action of the siphon 20 from being vanished due to the discharge of the condensation "W".

The siphon 20 is comprised of a first siphon 20*a* that is bent in the shape of an inverse U and a second siphon 20*b*. The inlet 21 of the first siphon 20*a* is placed at a predetermined depth in the water tank 10. The outlet 22*a* on the outside is placed at a predetermined depth in the siphon action maintainer 100. In the second siphon 20*b*, the inlet 21*a* is located at a higher level than that of the outlet 22*a* of the first siphon 20*a*, and the inlet 21*a* is inserted from the bottom of the siphon action maintainer 100. The outlet 22 is located at a lower level than that of the inlet 21 of the first siphon 20*a*.

The siphon action maintainer 100 is configured as a hollow housing, and an air hole 101 is formed at the top of the housing so that air pressure acts in the inside. It does not matter that the outlet 22*a* of the first siphon 20*a* can pass away the inlet 21*a* of the second siphon 20*b* side by side in a long height. It is preferred that in the siphon action maintainer 100, the guide pipes 102, 103 that are extended to each other can be formed integrally. The first, second siphon 20*a*, 20*b* can be assembled to the integral guide pipe.

The siphon action maintainer 100 is located at a same level as the water tank 10 disposed at the inside (or in the air conditioner).

After the siphon operation starts, the condensation "W" in the water tank 10 is discharged to the outside. The water level in the water tank 10 reaches the top end of the guide pipe 103 or the inlet 21*a* of the second siphon 20*b*. The air flows into the siphon action maintainer 100 though the air hole 101, and air pressure exerts on the water surface of the siphon action maintainer 100. No more discharge occurs, and the condensation "W" fills in the first siphon 20*a*.

Therefore, even if the discharge ceases, the siphon does not diminish, and the temporary suspension sustains. After that, as the water level of the water tank 10 comes up, the siphon action resumes exhausting the condensation without the fill up by the hydraulic pressure chamber 70.

When the air conditioner starts at the first time, the hydraulic pressure chamber 70 operates at one time. After that, the siphon automatically starts according to the inflow of the condensation "W". Condensation "W" can be automatically discharged.

According to the present invention—an automatic draining apparatus for condensation, without providing the water pump and the water level sensor as the conventional art, the condensation in the water tank can be automatically pumped by the buoyancy, and can be filled in the siphon. The condensation can be discharged with no power and no noise.

Therefore, the present invention has superior advantages in the reliance, silence and improving convenience of the apparatus (e.g. an air conditioner or a dehumidifier) that generates the condensation during the operation.

What is claimed is:

1. An automatic draining apparatus of condensation of an air conditioner or a dehumidifier comprising:

a water tank for holding condensation;

a float floating on the surface of the condensation and moving up/down along the level of the condensation;

a hydraulic pressure chamber consisting of a hollow room and a check valve, the hollow room having a volume changeable area for containing the condensation, the check valve provided at an inlet of the hydraulic pressure chamber, and the check valve allowing the condensation to flow only into the hollow room, the hydraulic pressure chamber being placed on the bottom of the water tank, the float moving up along the rising of the condensation and pulling up the hydraulic pressure chamber so that the volume of the hollow room is reduced and the condensation of the hollow room is pressurized; and a siphon having an inlet connected to the hydraulic pressure chamber and the inlet being functioned as an outlet of the hydraulic pressure chamber, and an outlet being provided at outside and a level of the outlet placing at a lower level of the inlet, the siphon draining the condensation in the water tank into the outside when the siphon is filled with the condensation by the condensation discharge from the compressed hydraulic pressure chamber.

2. The automatic draining apparatus of condensation of the air conditioner or the dehumidifier according to claim 1, wherein the automatic draining apparatus further comprises a tower and a push rod, the hydraulic pressure chamber is vertically provided at a hole of the float and slides along the hole of the float, the tower pulls up the hydraulic pressure chamber that falls down from the hole of the float, and the push rod is extended down perpendicular to the center of the water tank, pushes down the hydraulic pressure chamber being raised with the float so that the volume of the hollow room of the container is reduced.

3. The automatic draining apparatus of condensation or the air conditioner or the dehumidifier according to claim 2, wherein the hydraulic pressure chamber comprises;

a volume changeable container having an area for containing condensation, a base provided at a bottom of the container, and a resilient member provided under the push rod for contracting/expanding the container along the up/down movement of the float.

4. The automatic draining apparatus of condensation or the air conditioner or the dehumidifier according to claim 3, wherein the resilient member is comprised of a coil spring provided in the container for maintaining the container in the expanded state, and a pusher formed at the middle inner wall of the hole of the float and contacting the top rim of the container.

5. The automatic draining apparatus of condensation or the air conditioner or the dehumidifier according to claim 3, wherein the resilient member is comprised of a head having a groove at an circumference of the head, and several spring holders protruding from a middle inner wall of the hole of the float in an angle interval, and clamping into or being released from the groove along the up/down movement of the float.

6. The automatic draining apparatus of condensation or the air conditioner or the dehumidifier according to claim 2, wherein the hydraulic pressure chamber is comprised of a volume changeable container having a smaller specific gravity than that of condensation; a base provided at the bottom of the container and having a little heavier specific gravity than that of condensation; and a pusher protruding from a middle inner wall of the hole and contacting on the upper rim of the container.

7. The automatic draining apparatus of condensation or the air conditioner or the dehumidifier according to claim 4, wherein a second check valve is further provided at a top of the container, which allows only the inflow of air, but blocks the discharge of condensation.

8. The automatic draining apparatus of condensation or the air conditioner or the dehumidifier according to claim 4, wherein the coil spring is mold in the container.

9. The automatic draining apparatus of condensation or the air conditioner or the dehumidifier according to claim 3, wherein the container is made of a bellows pipe.

10. The automatic draining apparatus of condensation or the air conditioner or the dehumidifier according to claim 2, wherein the tower is comprised of many guide grooves and supporters, each guide groove is formed in a vertical manner around the hole of the float at a certain distance, and a protrusion is provided at a top of each supporter, that slides into the guide groove.

11. The automatic draining apparatus of condensation or the air conditioner or the dehumidifier according to claim 10, wherein the pusher and the guide groove are arranged around a circumference of the float in a certain angle interval.

12. The automatic draining apparatus of condensation or the air conditioner or the dehumidifier according to claim 3, wherein a water channel of the base is connected to an area of the container, the inlet of the water channel has a check valve, an outlet of the water channel is connected to the inlet of the siphon.

* * * * *

UNITED STATES PATENT AND TRADEMARK OFFICE

CERTIFICATE OF CORRECTION

PATENT NO. : 7,610,697 B2
APPLICATION NO. : 11/613454
DATED : November 3, 2009
INVENTOR(S) : Wan Young Lee It is certified that error appears in the above-identified patent and that said Letters Patent is hereby corrected as shown below:

Column 18

Line 4 in Claim 3, replace "or" in the first line with "of"

Line 13 in Claim 4, replace "or" in the first line with "of"

Line 20 in Claim 5, replace "or" in the first line with "of"

Line 27 in Claim 6, replace "or" in the first line with "of"

Line 36 in Claim 7, replace "or" in the first line with "of"

Line 41 in Claim 8, replace "or" in the first line with "of"

Line 44 in Claim 9, replace "or" in the first line with "of"

Line 47 in Claim 10, replace "or" in the first line with "of"

Line 54 in Claim 11, replace "or" in the first line with "of"

Line 58 in Claim 12, replace "or" in the first line with "of"

Signed and Sealed this

Fifth Day of January, 2010

David J. Kappos

David J. Kappos
*Director of the United States Patent and Trademark Office*